US010457513B2

(12) United States Patent
Maddaleni et al.

(10) Patent No.: US 10,457,513 B2
(45) **Date of Patent: *Oct. 29, 2019**

(54) REWINDING MACHINE AND METHOD FOR PRODUCING ROLLS OF WEB MATERIAL

(71) Applicant: Fabio Perini S.p.A., Lucca (IT)

(72) Inventors: Romano Maddaleni, Bientina (IT); Franco Montagnani, Palaia (IT); Roberto Morelli, S. Maria a Colle (IT)

(73) Assignee: Fabio Perini S.p.A., Lucca (IT)

( * ) Notice: Subject to any disclaimer, the term of this patent is extended or adjusted under 35 U.S.C. 154(b) by 225 days.

This patent is subject to a terminal disclaimer.

(21) Appl. No.: 15/582,999

(22) Filed: May 1, 2017

(65) Prior Publication Data

US 2017/0233208 A1 Aug. 17, 2017

Related U.S. Application Data

(62) Division of application No. 14/772,464, filed as application No. PCT/IB2013/061289 on Dec. 23, 2013, now Pat. No. 9,856,102.

(30) Foreign Application Priority Data

Mar. 6, 2013 (IT) ..... FI2013A0046

(51) Int. Cl.

| | |
|---|---|
| ***B65H 19/26*** | (2006.01) |
| ***B65H 19/22*** | (2006.01) |
| ***B65H 19/30*** | (2006.01) |

(52) U.S. Cl.

CPC ..... *B65H 19/267* (2013.01); *B65H 19/2269* (2013.01); *B65H 19/26* (2013.01); *B65H 19/30* (2013.01); *B65H 2301/41468* (2013.01); *B65H 2301/41826* (2013.01); *B65H 2301/51514* (2013.01); *B65H 2301/51539* (2013.01); *B65H 2408/235* (2013.01)

(58) Field of Classification Search

CPC ..... B65H 19/26; B65H 19/30; B65H 19/267; B65H 19/2269

See application file for complete search history.

(56) References Cited

U.S. PATENT DOCUMENTS

| | | | |
|---|---|---|---|
| 3,567,144 | A | 3/1971 | Dambroth |
| 4,783,015 | A | 11/1988 | Shimizu |

(Continued)

FOREIGN PATENT DOCUMENTS

| | | | |
|---|---|---|---|
| EP | 2253568 | A2 | 11/2010 |
| JP | 57077147 | A | 5/1982 |

(Continued)

*Primary Examiner* — Sang K Kim

(74) *Attorney, Agent, or Firm* — Breiner & Breiner, L.L.C.

(57) ABSTRACT

The rewinding machine includes a first winding cradle, formed between a first winding roller, a second winding roller and a third winding roller, and a second winding cradle formed between the first winding roller, the second winding roller and a fourth winding roller. The first winding roller and the second winding roller define a nip through which nip the winding cores, around which the web material is found, pass and the web material is fed towards a roll being formed in the second winding cradle. A severing member is furthermore provided, acting on the web material between a winding core and the nip, to sever the web material thus generating a tail edge of a completed roll and a leading edge of a new roll to be wound.

8 Claims, 17 Drawing Sheets

(56) References Cited

U.S. PATENT DOCUMENTS

| | | | |
|---|---|---|---|
| 5,979,818 | A | 11/1999 | Perini et al. |
| 6,098,916 | A | 8/2000 | Matteucci et al. |
| 7,775,476 | B2 | 8/2010 | Recami et al. |
| 2007/0176039 | A1 | 8/2007 | Gelli et al. |
| 2009/0095836 | A1 | 4/2009 | Maddaleni et al. |
| 2013/0221150 | A1 | 8/2013 | Morelli et al. |

FOREIGN PATENT DOCUMENTS

| | | | |
|---|---|---|---|
| JP | 57-103952 | A | 6/1982 |
| JP | 58152750 | A | 9/1983 |
| WO | 2011104737 | A1 | 9/2011 |

27
2
12
12A
8
8A
f12
N
9A
A1
fN
f9
1
L1
9
10
7
1A
5
1B
3A
31
6
7A
24A
3
A2
11
C
19
15
19B
21
f23
19C
1C
19A
24
3B
14
23
3C
23A 27
2
12
12A
8
8A
f12
N
9A
A1
fN
f9
1
L1
9
10
1A
5
7
3A
31
7A
3
1B
A2
19
19B
19C
f23
1C
19A
24
3B
14
23
3C
23A
11
15

27
12
12A
2
f12
N
8
fN
f9
1
8A
L1
A1
9A
1A
7
5
1B
3A
31
9
7A
A2
3
19
1C
19B
19C
f23
11
24
19A
3B
23
3C
23A
15
14

27
12A
12
2
$f_{12}$
N
8
9A
1
$f_N$
$f_9$
8A
10
9
1A
L2
A2
7
31
3A
1B
7A
24A
3
1C
19B
19C
19
11
21
24
19A
3B
23
15
3C
23A
14

27
2
12
12A
8
8A
f12
A1
L1
10
N
9A
1
fN
f9
1A
f53
9
23
5
31
6
53
7A
3A
3
19C
1B
7
A2
51
54
1C
21
11
19
15
19B
C
51A
3B
3C
14

27
2
12
12A
8
8A
f12
A1
L1
9A
N
1
f9
fN
10
9
1A
5
31
7
53
6
3A
7A
19C
3
1B
54
1C
19
51
A2
11
19B
3B
51A
15
3C
14

27
2
12
12A
8
8A
f12
N
fN
9A
f9
1
A1
L1
10
9
23
1A
5
31
A2
3A
3
7A
1B
19
53
7
21
54
1C
51
19C
11
19B
15
3B
51A
3C
14

27
12A
12
2
N
8
9A
1
8A
$f_N$
$f_1$
$f_8$
1A
L2
9
7
31
$f_9$
7A
A2
3A
$f_3$
1B
19
21
3
1C
23
19C
53
11
51
54
19B
51A
3B
15
3C
14

27
2
12
12A
8
8A
f12
N
fN
9A
f9
1
A2
L2
9
10
1A
5
31
6
19
3A
3
7A
1B
19C
54
1C
21
53
A3
7
19B
23
11
C
51
51A
3B
15
3C
14

27
2
12
12A
8
8A
f12
A2
L2
10
N
9A
1
fN
f9
1A
5
9
7
31
6
3A
3
7A
f23
1B
53
21
1C
11
A3
19
23
54
15
19B
51A
3B
3C
14

27
2
12
12A
8
8A
f12
A2
L2
10
N
9A
1
fN
f9
9
1A
5
7
53
6
31
3A
3
7A
19C
1B
1C
54
51
A3
19
11
19B
3B
51A
15
3C
14

27
2
12
12A
8
8A
f12
N
fN
9A
f9
1
A2
L2
1A
10
9
53
5
31
7
A3
3A
7A
3
1B
19
21
54
1C
51
19C
11
19B
15
51A
3B
3C
14

REWINDING MACHINE AND METHOD FOR PRODUCING ROLLS OF WEB MATERIAL

RELATED APPLICATIONS

The present application is a division of U.S. Ser. No. 14/772,464 filed Sep. 3, 2015, which in turn is the National stage of International Application No. PCT/IB2013/061289 filed Dec. 23, 2013, each of these applications being incorporated herein by reference.

TECHNICAL FIELD

The present invention relates to methods and machines to produce rolls of web material, particularly, although without limitation, paper rolls, especially tissue paper rolls, for instance rolls of toilet paper, kitchen towels or the like.

STATE OF THE ART

In the paper industry, particularly in the production of logs of toilet paper, kitchen towels or the like, reels of large dimensions (called parent reels) are formed by winding tissue paper coming directly from the continuous paper-making machine. These reels are then unwound and rewound to produce rolls or logs of smaller diametric dimensions, corresponding to the diametric dimension of the end product intended for consumption. These rolls have an axial length equal to a multiple of the finished roll intended for sale and are therefore cut by means of severing machines to form the end products destined for use, which are then packaged and sold.

For producing logs or rolls of web material, the modern rewinding machines use winding rollers that, combined and arranged in various ways and adequately controlled, allow to automatically produce logs or rolls at high rate by means of continuous feed of the web material. After a roll has been wound, it shall be moved away from the winding area, severing the web material (through cutting or tearing thereof or in another way), thus allowing to start the winding of a subsequent log or roll. Usually, winding is performed around winding cores, typically, although not exclusively, made of cardboard, plastic or other adequate material. In some cases winding is performed around mandrels that can be removed and recycled, i.e., that are removed from the completed roll after it has been completely wound, and are then inserted again into the rewinding machine to wind a new roll.

In the newest rewinding machine the winding motion is imparted to the logs or rolls through contact with two or more rollers rotating at controlled speed. These rewinding machines are called surface rewinding machines, as the winding movement is imparted peripherally through contact between the surface of the winding rollers and the surface of the rolls or logs being formed. Examples of automatic continuous surface rewinding machines of this type are described in the U.S. Pat. No. 5,979,818 and in other patents of the same class, as well as in the reference documents cited in this patent. An improvement to the machine described in this US patent is disclosed in WO-A-2011/104737 and in W02007/083336. In these known rewinding machines the web material is severed by means of a severing, cutting, or tearing member, which cooperates with a winding roller having a fixed axis, around which the web material is fed and which defines, together with a second winding roller, a nip where the winding cores are inserted.

These machines are also referred to as continuous and automatic machines, as the various steps of the winding cycle of each roll follow one another automatically, that is to say from the production of one roll to the production of the subsequent roll without stopping and supplying the web material at nearly or substantially constant speed. In this description and in the appended claims the term "automatic continuous rewinding machine" will be used to indicate this type of machines.

One of the critical phases in the continuous automatic surface rewinding machines of the type described above is the so-called exchange phase, i.e., the step where operations are performed to sever the web material, unload the finished log, and start winding a new log around a new winding core inserted in the winding nip.

Different solutions have been studied to perform these operations automatically, quickly and effectively, for instance using winding rollers rotating at controlled speed that accelerate and/or decelerate in a synchronized manner to facilitate the correct movement of the finished rolls and of the new cores. In some cases tearing systems have been provided, wherein the web material is severed by means of speed difference. In other cases pressurized air systems, suction systems, mechanical systems or the like have been provided to sever the web material.

WO-A-2012/042549 discloses an automatic surface rewinding machine with four rollers. The use of four rollers, all of which, or at least some of which have movable axes, allows to define two winding cradles and to control the roll being formed more effectively. In some embodiments described in that document, the roll being formed is always in contact with at least three winding rollers and, in some cases, it can be temporarily in contact with four winding rollers. This allows controlling the winding cycle, the shape of the roll and the winding density in a particularly efficient way. In some embodiments the web material is severed by lengthening the path thereof between two winding rollers. This results in the web material being severed to form a free tail edge of a completed roll and a free leading edge of the subsequent roll to start winding this latter on a new core. This machine allows achieving appreciable results in terms of winding accuracy and operation reliability; however, it has some aspects that can be improved. Particularly, in some cases the correct operation and the reproducibility of the winding cycle may depend upon the features of the processed material, i.e., of the web material and/or the winding cores.

SUMMARY OF THE INVENTION

According to what is described above, an automatic continuous surface rewinding machine with four rollers is provided, wherein rolls of web material are wound around winding cores at very fast frequency, without stopping supplying the web material, i.e., feeding the web material continuously or substantially continuously towards a winding head, comprising, in addition to the winding rollers, a mechanism for severing the web material at the end of every winding cycle.

"Continuously or essentially continuously feed" means that the feed speed of the web material is substantially independent of the winding cycle, being understood that other factors can change, also considerably, the feed speed of the web material. For instance, to replace a parent reel from which the web material is supplied, or in the case the web material breaks, it could be necessary to slow down or even to stop the feed of the web material towards the winding head. However, this speed change or stop is not linked to the winding cycle of the single rolls.

Advantageously, the winding head of the rewinding machine may comprise a first winding roller, a second winding roller and a third winding roller, defining a first winding cradle. A fourth winding roller forms, together with the first winding roller and the second winding roller, a second winding cradle. The first winding roller and the second winding roller define a nip through which the winding cores pass, with the roll being formed around them, moving from the first to the second winding cradle.

Advantageously, both the third and fourth winding roller have a movable axis to follow the motion of the winding core and of the roll in the first winding cradle, in the second winding cradle and in the nip between these cradles.

Suitably, a severing member for the web material cooperates with the third winding roller, i.e., the first roller the web material meets when entering the winding area or winding head.

The severing member may be designed and controlled so as to pinch the web material between the severing member and the third winding roller. The third winding roller may have a surface with a low friction coefficient in the area where the severing member presses, for instance annular bands with low friction coefficient. When the web material is pinched against the third winding roller by the pressing members of the severing member, or other similar members with which the severing member is provided, it slides on this roller and remains substantially stationary, held by the severing member. This results in the web material being tensioned downstream of the severing member, causing tearing thereof. In case of perforated web material, tearing occurs at a perforation line.

The pinching movement may be completely performed by the severing member only. In some embodiments the pinching movement may be performed by the third winding roller, or partly by the third winding roller and partly by the severing member. In general, the movement is referred to the fixed structure of the machine.

In other embodiments, the severing member may comprise a linear element extending transversally with respect to the feed path for the web material and therefore substantially parallel to the axes of the winding rollers. The linear element of the severing member may be provided with a continuous or alternating severing movement, causing the passage of said linear element through the web material feed path, so that the web material is severed by means of the linear element. In this case, the severing member cooperates advantageously with the third winding roller, acting onto the web material in a portion thereof comprised between the third winding roller and the roll being formed in the second winding cradle. The path of the linear element may extend between the first winding roller and the third winding roller.

In practical embodiments, the movement of the linear element is substantially orthogonal to the longitudinal development of said linear element. For instance, the linear element may be provided with a movement along a circular trajectory. In advantageous embodiments the linear element may be supported by arms pivoting around an axis of rotation. In other embodiments the movement of the linear element may be a translation movement.

The linear element may comprise a wire. To efficiently sever the web material, the linear element may be tensioned. To this end one or more tensioning members may be provided, such as a hydraulic jack or the like.

In advantageous embodiments, the linear element may be a wire, a cable, a stranded wire or any other element whose cross section is such to reduce bending deformations resulting from dynamic stresses during motion. In some embodiments the linear element has a nearly circular cross section.

The linear element may be made of materials with high tensile strength, for instance fibers of Kevlar, i.e., aramid fibers.

The linear element may be provided with reciprocating motion, controlled so as to move alternatively from one to the other of two rest positions that can define the end positions of the trajectory along which the linear element moves. These two positions are adequately arranged on opposite sides of the path of the web material. In this way the operation of the linear element is reciprocating, i.e. in a working cycle, that is when a first winding ends, the linear element acts onto the web material severing it through a movement from the first to the second position, crossing the path of the web material in one direction. When a second, i.e. a subsequent winding cycle ends, the linear elements performs a second working cycle moving contrarily than in the previous working cycle, i.e. crossing the path of the web material in opposite direction, moving from the second to the first position.

In other embodiments the linear element may have a rotary motion in a single direction, discontinuous and synchronized with the roll formation. The linear element may be carried for instance by arms pivoted around the axis of the first winding roller.

In general, both the third winding roller and the severing member are movable. The third winding roller (or more specifically the axis of rotation thereof) is movable to follow the forward movement of the roll in the first winding step towards the nip between the first and the second roller and to come back into the start position for receiving a new core. In some embodiments the severing member is movable to take a position where it cooperates with the third winding roller and a position where it allows the passage of the new core when the winding starts. These two movements are suitably coordinated with each other, so that the third winding roller is positioned correctly and in phase with the movement of insertion of a new winding core. The third roller is positioned so as to allow the winding core to be correctly inserted and controlled and to allow the cooperation between the roller and the severing member. While in the known rewinding machines provided with a severing member this latter usually cooperates with a winding roller having a fixed axis, according to some embodiments of the rewinding machine described herein the severing member cooperates with a winding roller having a movable axis, that performs a relatively wide movement for accompanying or following the new core and the roll when the winding starts and a subsequent movement back towards the start position for inserting the new winding core.

According to an embodiment, a continuous automatic surface rewinding machine is therefore provided, for producing rolls of web material wound around winding cores, comprising a first winding cradle formed between a first winding roller, a second winding roller, and a third winding roller, and a second winding cradle, formed between the first winding roller, the second winding roller and a fourth winding roller; wherein the first winding roller and the second winding roller define a nip; through said nip the winding cores, around which the web material is wound, pass and the web material is fed towards a roll being formed in the second winding cradle. The winding rollers are arranged and controlled to perform a first part of the winding of a roll between the first winding roller, the second winding roller and the third winding roller, and a final part of the winding of a roll between the first winding roller, the second winding roller and the fourth winding roller, the fourth winding roller being arranged downstream of the nip and the third winding roller being arranged upstream of the nip, with respect to the feed direction of the winding cores. The third winding roller and the fourth winding roller have movable axes and are controlled so as to translate orthogonally to their axis, following the movement of the roll during growing thereof and transferring from the first winding cradle to the second winding cradle. The machine further comprises a severing member cooperating with the third winding roller and acting on the web material between a winding core and the nip, to sever the web material thus generating a tail edge of a completed roll and a leading edge of a new roll to be wound. In some embodiments the severing member comprises advantageously pressing members pushing against the third winding roller. In other embodiments the severing member comprises a linear or wire-shaped element moving transversally to the (feed path of the) web material, to sever it after it has been completely wound.

In practical embodiments the machine comprises a curved rolling surface extending around the third winding roller and ending at the second winding roller forming an area for the passage of the winding cores and of the rolls from the rolling surface to the second winding roller; wherein between the curved rolling surface and the third winding roller a feeding channel is defined for feeding the winding cores.

According to a different aspect, a method is provided to wind a web material and produce in sequence rolls of said web material wound around winding cores, comprising the steps of: arranging four winding rollers defining a first winding cradle between a first winding roller, a second winding roller, and a third winding roller, and a second winding cradle between said first winding roller, said second winding roller and a fourth winding roller; performing a first part of a winding cycle of each roll in the first winding cradle, and a subsequent part of the winding cycle of each roll in the second winding cradle, the roll being wound moving from the first winding cradle to the second winding cradle through a nip defined between the first winding cradle and the second winding cradle. When a roll has been completely wound, the web material is severed by means of a severing member cooperating with the third winding roller. In some embodiments the web material is severed by pinching it against the third winding roller. In other embodiments the web material is severed by means of a movable cutting or severing linear element that intersects the feed path of the web material, downwards of the third winding roller. The linear element severs the web material crossing the feed path thereof between the third winding roller and the roll being completed in the second winding cradle.

As the third winding roller is movable and controlled to move during the winding cycle of each roll, the machine and the method of the invention provide advantageously for synchronizing the movement of the axis of the third winding roller and the movement of the severing member.

In some embodiments the machine comprises a curved rolling surface extending around the third winding roller and ending at the second winding roller forming an area for the transfer of the winding cores and of the rolls from the rolling surface to the second winding roller. Between the curved rolling surface and the third winding roller a feeding channel is defined for feeding the winding cores. When the severing member comprises a linear element, this latter may enter a seat provided in the curved rolling surface. In some embodiments the curved rolling surface may be defined by the edges of a plurality of laminar elements adjacent to one another and aligned nearly parallel to the axes of the winding rollers. In this case, each laminar element may have a groove or notch inside which the linear element can penetrate. The grooves or notches of the single laminar elements are advantageously aligned with one another to form an elongated seat, inside which the linear element enters when moving towards the side of the path of the web material, on which the rolling surface is located.

Further features and embodiments of the invention will be described in greater detail below with reference to the accompanying drawings and are defined in the attached claims, which form an integral part of the present description.

BRIEF DESCRIPTION OF THE DRAWINGS

The invention will be easier to understand by means of the description below and the attached drawing, which shows non-restrictive practical embodiments of the invention. More in particular, in the drawing.

DETAILED DESCRIPTION OF EMBODIMENTS OF THE INVENTION

Figure 1:
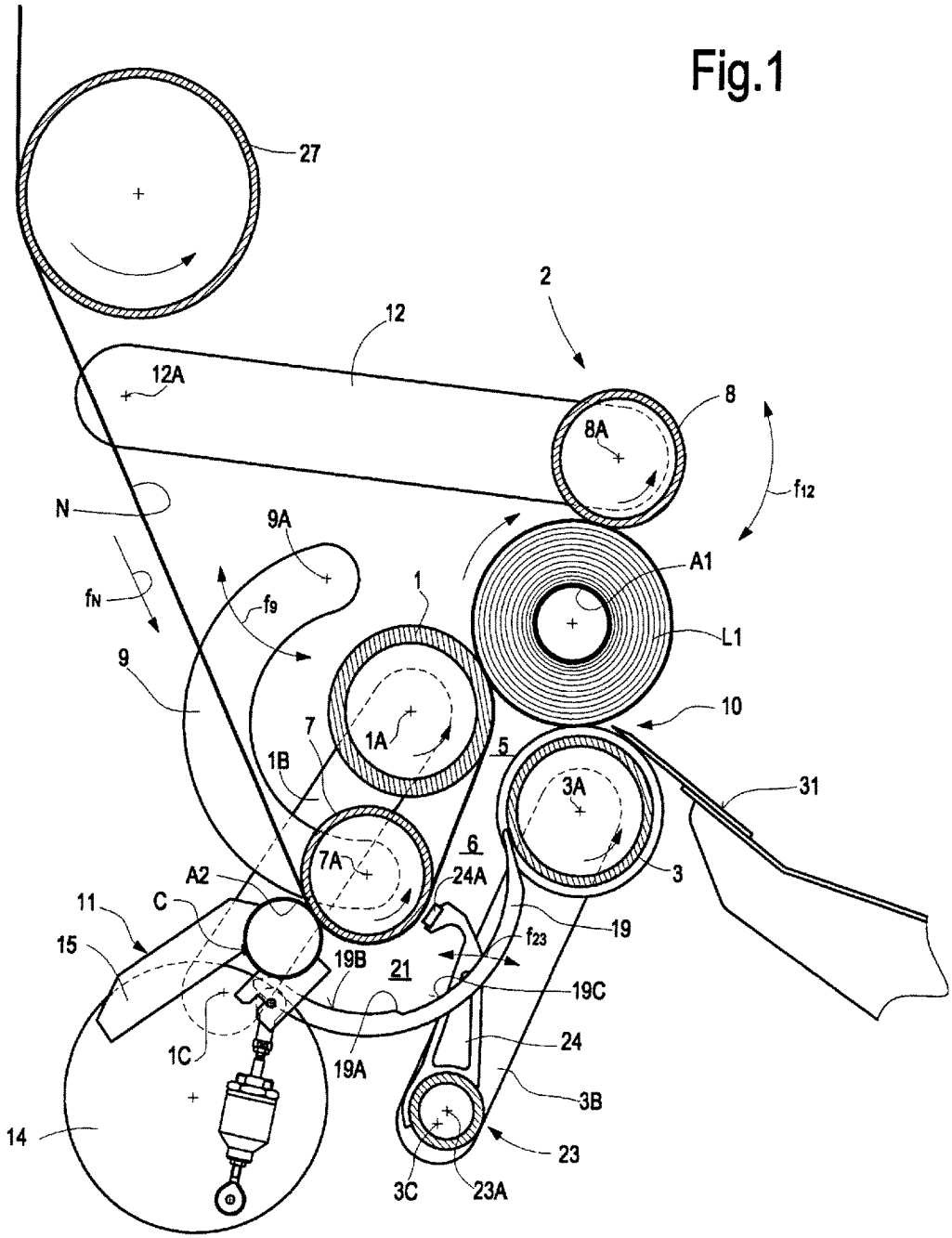
FIGS. 1 to 5 schematically show a first embodiment of a rewinding machine according to the invention in an operating sequence.

FIGS. 1 to 5 illustrate an embodiment of a continuous surface rewinding machine according to the invention and an operating sequence showing particularly the exchange phase, i.e., the phase of unloading a log or roll after it has been completely wound and inserting a new winding core to start the formation of a whole log or roll.

FIGS. 1 to 5 show only the main elements of the rewinding machine necessary for an understanding of the general operation of the machine and the concepts upon which the invention is based. Construction details, auxiliary groups and further components are known and/or can be designed according to the prior art, and are not therefore illustrated in the drawing or described in greater detail; those skilled in the art can produce these further components based upon their experiences and knowledge of paper converting machinery.

Summarizing, in the illustrated embodiment the machine, indicated as a whole with number 2, comprises a first winding roller 1 with rotation axis 1A, arranged at the side of a second winding roller 3 having rotation axis 3A. The axes 1A and 3A are parallel to each other. Between the two winding rollers 1 and 3 a nip 5 is defined, through which a web material N is fed (at least during part of the winding cycle of each roll) to be wound around winding cores A1, A2, around which logs or rolls L1 form.

As it will be better explained below, also the winding cores pass through the winding nip 5. The winding cores A1, A2 are inserted in the machine upstream of the nip 5 in a first winding cradle 6 formed by the first winding roller 1, by the second winding roller 3 and by a third winding roller 7. 7A indicates the rotation axis of the third winding roller 7, parallel to the axes 1A and 3A of respectively the first winding roller 1 and the second winding roller 3.

The winding cores terminate receiving the web material N wound around them when they are in a second winding cradle 10 arranged downstream of the nip 5. The second winding cradle is formed by the first winding roller 1, by the second winding roller 3 and by a fourth winding roller 8. The rotation axis of the fourth winding roller 8 is indicated with 8A. Number 12 indicates a pair of arms hinged at 12A and supporting the fourth winding roller 8. The arrow f12 indicates the oscillation movement, i.e., the movement of reciprocating rotation of the arm 12, and consequently of the fourth winding roller 8. In other embodiments the fourth winding roller 8 may be carried by a system comprised of slides movable on linear guides, instead of arms pivoted around an axis of oscillation or reciprocating rotation.

If not otherwise specified, in the description and in the appended claims the terms "upstream" and "downstream" refer to the feed direction of the web material and of the axis of the winding core.

The third winding roller 7 is provided with a movement towards and away from the winding nip 5. To this end, in some embodiments the third winding roller 7 is supported by a pair of arms 9 pivoted around an axis 9A to oscillate, i.e., to rotate in a reciprocating manner according to the double arrow f9. In other embodiments, not shown, the third winding roller 7 may be supported by slides movable on linear guides, so as to follow a rectilinear trajectory.

The path of the web material N extends around the third winding roller 7 and around the first winding roller 1, forming, during some steps of the winding cycle (see for instance FIG. 1), a portion of web material between the two rollers 7 and 1.

Upstream of the winding nip 5, of the first winding roller 1 and of the second winding roller 3 a core feeder 11 is arranged, that can be designed in any suitable manner.

The winding cores may come from a so-called core-winder, i.e. a machine for forming the winding cores associated with the converting line for the web material N, wherein the rewinding machine 2 is arranged.

In this case, the core feeder 11 comprises a rotating equipment 14 carrying gripping member 15 engaging the winding cores and transferring them towards a feeding channel, described below.

In some embodiments the rewinding machine comprises a rolling surface 19 for the winding cores. The rolling surface 19 may have an approximately cylindrical shape, generally coaxial with the third winding roller 7 having a movable axis, when this roller is in the position of FIG. 1. The rolling surface 19 may have a step 19A in an intermediate position along its extension. Downstream and upstream of the step 19A there are two portions 19B and 19C of the rolling surface 19. The two portions 19B, 19C may have different radius of curvature, the radius of the portion 19C being preferably greater and the radius for the portion 19B being preferably smaller.

The rolling surface 19 and the cylindrical surface of the third winding roller 7 form a feeding channel 21 for the winding cores A11, A2. When the third winding roller 7 is in the position of FIGS. 1 to 4, the height of the feeding channel 21 for the winding cores is lower in the first channel portion, corresponding to the portion 19B of the rolling surface 19, and greater in the second portion of the feeding channel 21, corresponding to the portion 19C of the rolling surface. This change in the height of the feeding channel 21 facilitates the rotation of each new winding core A1, A2 inserted in the feeding channel 21, as it will be explained later on.

In some embodiments the rolling surface 19 is formed by a comb-shaped structure, with a plurality of arched plates adjacent to one another, between which there are free spaces. A severing member, indicated as a whole with number 23, for the web material N can be inserted through said free spaces between adjacent plates forming the rolling surface 19. The severing member 23 may be a presser, comprising a plurality of pressing members 24. The severing member 23 is movable in reciprocating rotary motion around an axis 23A approximately parallel to the axes of the winding rollers. f23 indicates the movement of the severing member 23. Each single pressing member may have a pressure pad 24A. The pressure pad 24A may be made for instance of an elastically yielding material with high friction coefficient, for instance rubber.

As it will be better illustrated below with reference to an operating cycle, synchronized with the movement of the other members of the machine, the severing member 23 is pressed against the third winding roller 7 to pinch the web material N between the pressers 24 and the surface of the third winding roller 7. This latter may have a surface with annular bands with high friction coefficient and annular bands with low friction coefficient. In this context, the term "high" and "low" indicate a relative value of the friction coefficients of the two series of annular bands alternated the ones with the others. The bands with low friction coefficient are in correspondence of areas where the pressing members 24 push. In this way, when the web material N is pinched against the third winding roller 7 by means of the pressing members 24, it tends to be stopped by the pads 24A and to slide on the annular bands with low friction coefficient of the third winding roller 7.

FIG. 1 shows a final step of the winding cycle of a first roll or log L1. As shown in FIG. 1, during this step of the winding cycle of a first log or roll L1 around a first winding core A1, the roll L1 is in the second winding cradle 10 in contact with the first winding roller 1, the second winding roller 3 and the fourth winding roller 8. The web material N is fed according to the arrow fN around the third winding roller 7 and around the first winding roller 1, and is wound on the roll L1 that is rotated by means of the rollers 1, 3, and 8 and is held by them in the winding cradle 10. Reference 27 indicates a guiding roller for guiding the web material N arranged upstream of the winding head defined by the winding rollers 1, 3, 7, and 8.

Preferably, the feed speed of the web material N is substantially constant. Substantially constant speed means a speed varying slowly with respect to the winding speed and because of factors that are independent of the operations performed by the members of the winding head described above, that are controlled so as to perform the winding cycle, to unload the completed roll, to insert a new core and to start the winding of a new roll at constant feed speed of the web material towards the groups of winding roller and in particular towards the third winding roller 7.

While the roll L1 is being wound, outside of the so-called exchange phase, i.e. a transitory phase in the operation of the machine, the peripheral speeds of the winding rollers 1, 3, 7, and 8 are substantially equal and all the various winding rollers rotate in the same direction, as indicated by the arrows in the drawing. "Substantially equal" means in this case that the speed can vary only according to the needs for controlling the compactness of the winding and the tension of the web material N between the winding roller 7 and the winding roller 8, for instance to balance the change in tension that could be caused by the displacement of the center of the roll being formed along the path between the winding rollers. In some embodiments this difference in the peripheral speeds of the rollers may be typically comprised between 0.1 and 1% and preferably between 0.15 and 0.5%, for instance between 0.2 and 0.3%, being understood that these values are given just by way of non limiting example. Furthermore, the peripheral speeds may vary slightly to cause the forward movement of the roll being formed, as explained below, so that it passes from the first winding cradle 6 to the second winding cradle 10.

The roll forming cycle will be described below with reference to FIGS. 1 to 5.

In FIG. 1 the roll L1, that is in the winding cradle 10 formed by the rollers 1, 3, 8, has been almost completed, the desired amount of web material N having been wound around the first winding core A1. A second winding core A2 has been put by the core feeder 11 at the entry of the feeding channel 21.

C indicates a continuous line of glue, or a series of spots of glue, applied on the outer surface of the second winding core A2.

Figure 2:
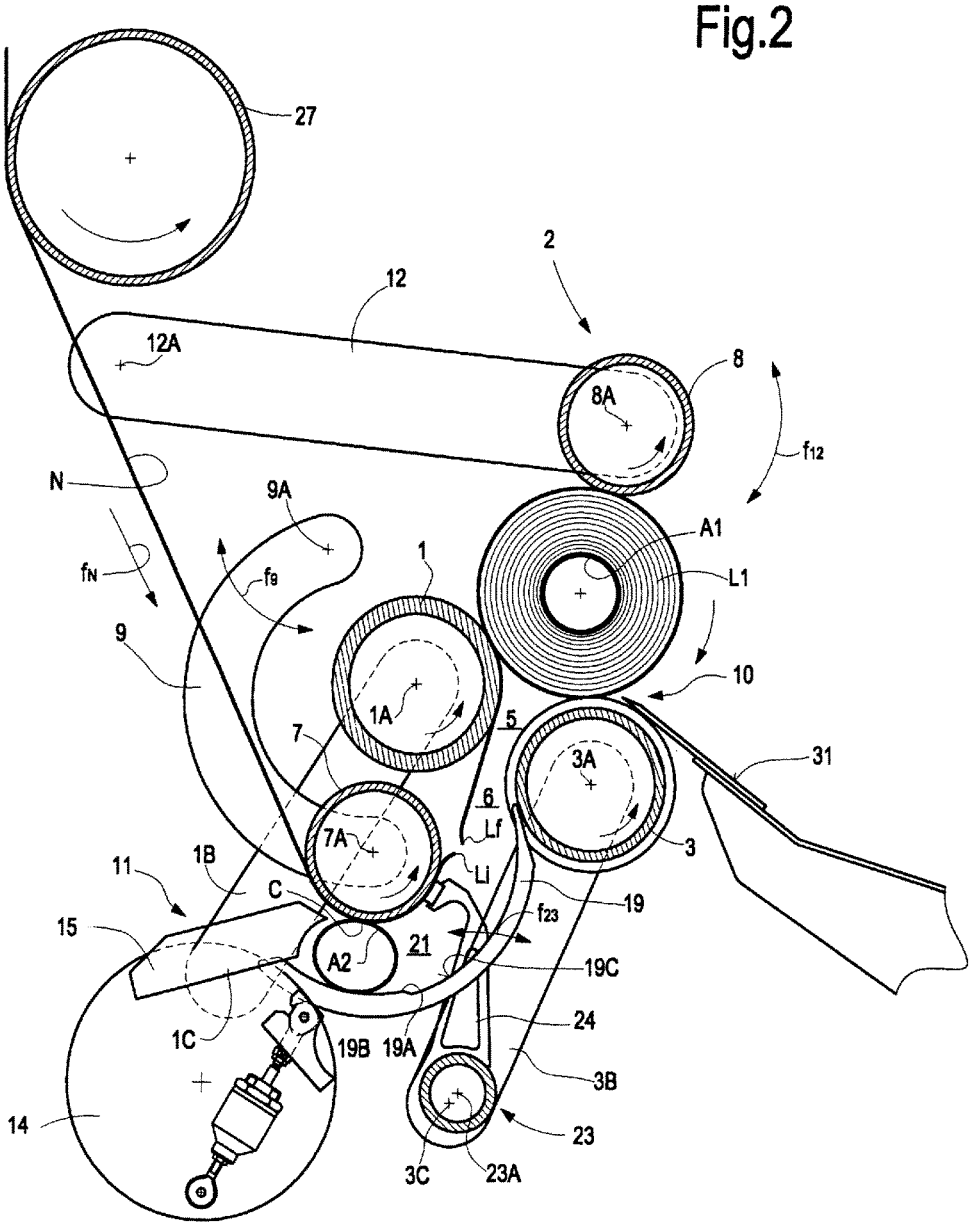

FIG. 2 shows the start of the exchange phase, i.e. the phase of unloading the completed roll L1 and inserting the new winding core A2.

The second winding core A2 in pushed by the core feeder 11 inside the feeding channel 21 defined between the third winding roller 7 and the rolling surface 19.

In this step of the winding cycle the third winding roller 7 is positioned so as to be approximately coaxial with the generally cylindrical rolling surface 19. The distance between the portion 19B of the rolling surface 19 and the cylindrical surface of the third winding roller 7 is slightly lower than the diameter of the winding core A2. In this way the winding core A2 is pushed while entering the feeding channel 21, thus generating a friction force between the surface of the same winding core A2 and the rolling surface 19, as well as between the surface of the winding core A2 and the web material N driven around the cylindrical surface of the third winding roller 7. Thus, due to the rotation of the third winding roller 7 and the forward movement of the web material N, the winding core A2 accelerates angularly, starting to roll on the rolling surface 19. Along the second portion 19C of the rolling surface 19, the radial dimension of the feeding channel 21 increases, reducing the diameter deformation of the winding core A2 and allowing starting winding of the web material N around it, with consequent formation of turns of a new roll.

During the rolling movement, the line of glue C applied on the winding core A2 comes into contact with the web material N, causing the adhesion thereof on the winding core.

In this step of the winding cycle also the breakage or severing of the web material by means of the severing member 23 takes place. This latter is made oscillate against the third winding roller 7, so as to pinch, by means of the pads 24A, the web material N against the surface of the third winding roller 7. As the winding rollers 1, 3, and 8 continue to rotate, winding the web material N on the roll L1, the web material is tensioned between said roll L1 and the point where the web material N is pinched against the third winding roller 7 by means of the severing member 23. The tension exceeds the breaking point, for instance in correspondence of a perforation line, thus generating a tail edge Lf, that will finish to be wound on the roll L1, and a leading edge Li, that will be wound on the new winding core A2.

Figure 3:
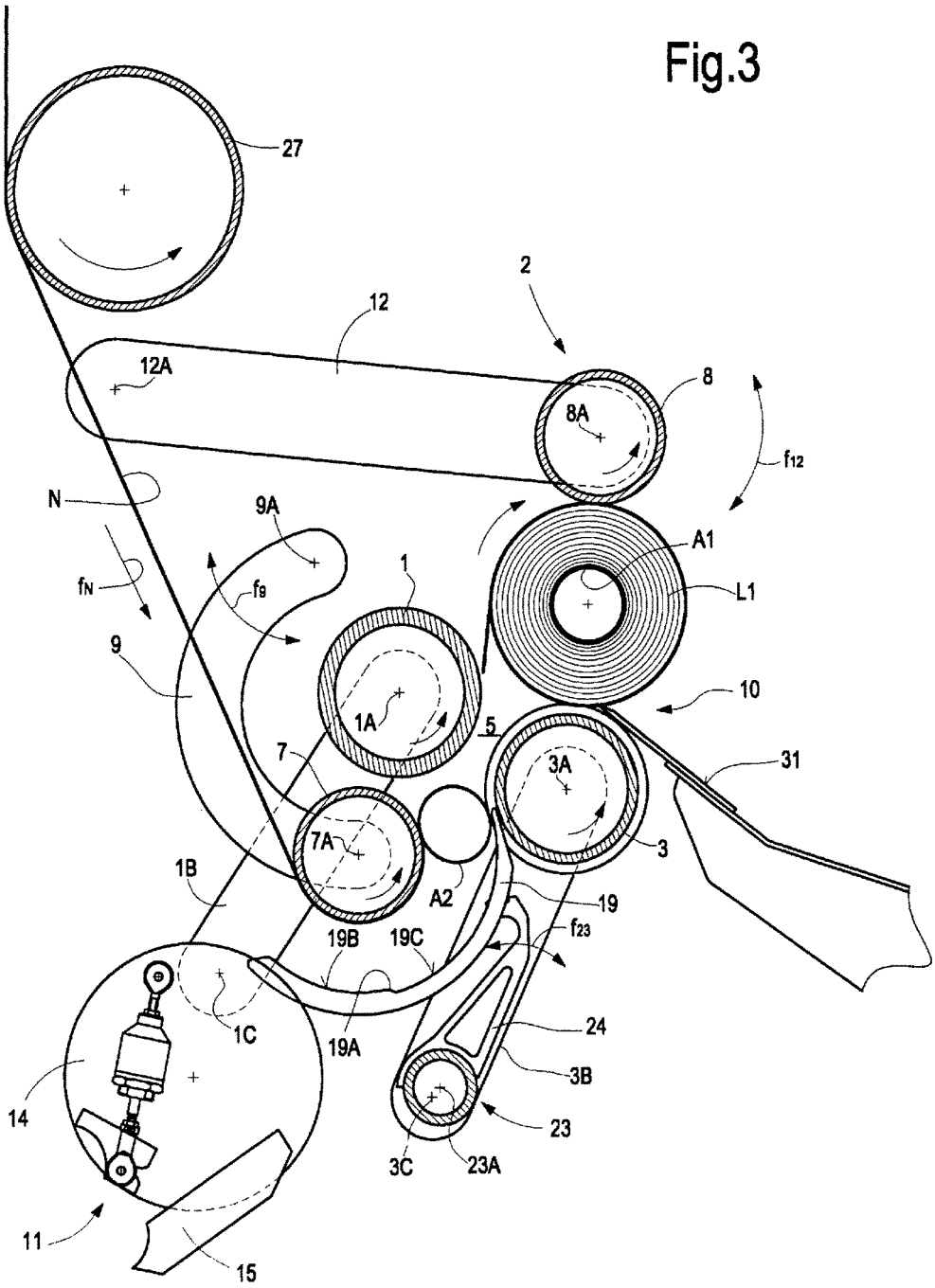

FIG. 3 shows the subsequent step, wherein the second winding core A2, rolling on the rolling surface 19, comes into contact with the cylindrical surface of the second winding roller 3. This latter may be provided with a series of annular channels, where the ends of the plates forming the rolling surface 19 are housed. In this way the winding core A2 is smoothly transferred from the rolling surface 19 to the surface of the second winding roller 3.

To allow the winding core A2 to move forward along the feeding channel 21, the severing member 23 has been made rotate around the axis 23A up to exit from the feeding channel 21. Thanks to the glue C, the web material N adhered on the winding core A2 and begins therefore to be wound on the winding core A2 thus starting the winding of a second roll L2 while the core moves forward rolling along the channel 21.

The first roll L1 starts the ejection movement from the second winding cradle 10, for instance by acting on the peripheral speeds of the rollers 1, 3, and 8. In some embodiments the roller 8 maybe accelerated angularly and/or the roller 3 may be slowed angularly to cause the movement of the roll L1 away from the second winding cradle 10 towards an unloading slide 31. The fourth winding roller 8 oscillates upwards to allow the passage of the roll L1 towards the unloading slide 31.

Figure 4:
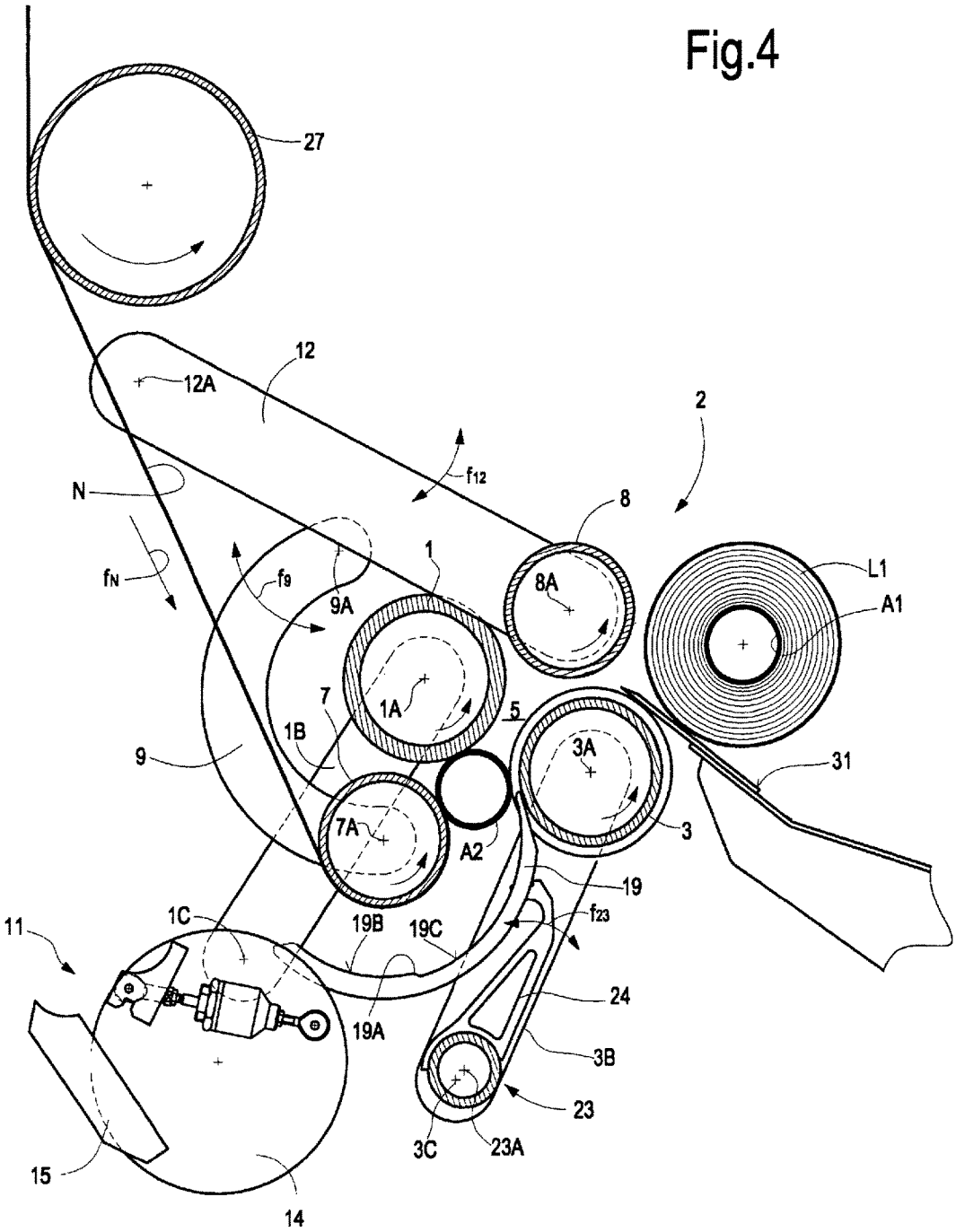

In FIG. 4 the second winding core A2 is in the first winding cradle 6 and is in contact with the first winding roller 1, the second winding roller 3 and the third winding roller 7.

The completed roll L1 is unloaded onto the slide 31.

The formation of the second roll L2 continues, feeding the web material N around the new winding core A2, with the diameter of the new roll L2 that consequently increases. The third winding roller 7 can move thanks to the movement of the arms 9 around the pivot or axis 9A, following the diameter increase of the second roll L2.

Once a part of the winding cycle has been performed in the winding cradle 6, the roll L2 is transferred in the second winding cradle 10, where the winding is completed. To this end it is necessary for the roll L2 to pass through the nip 5. To this end, in some embodiments one or preferably both the winding rollers 1 and 3 are supported by respective arms 1B, 3B oscillating around oscillation axes IC, 3C.

Figure 5:
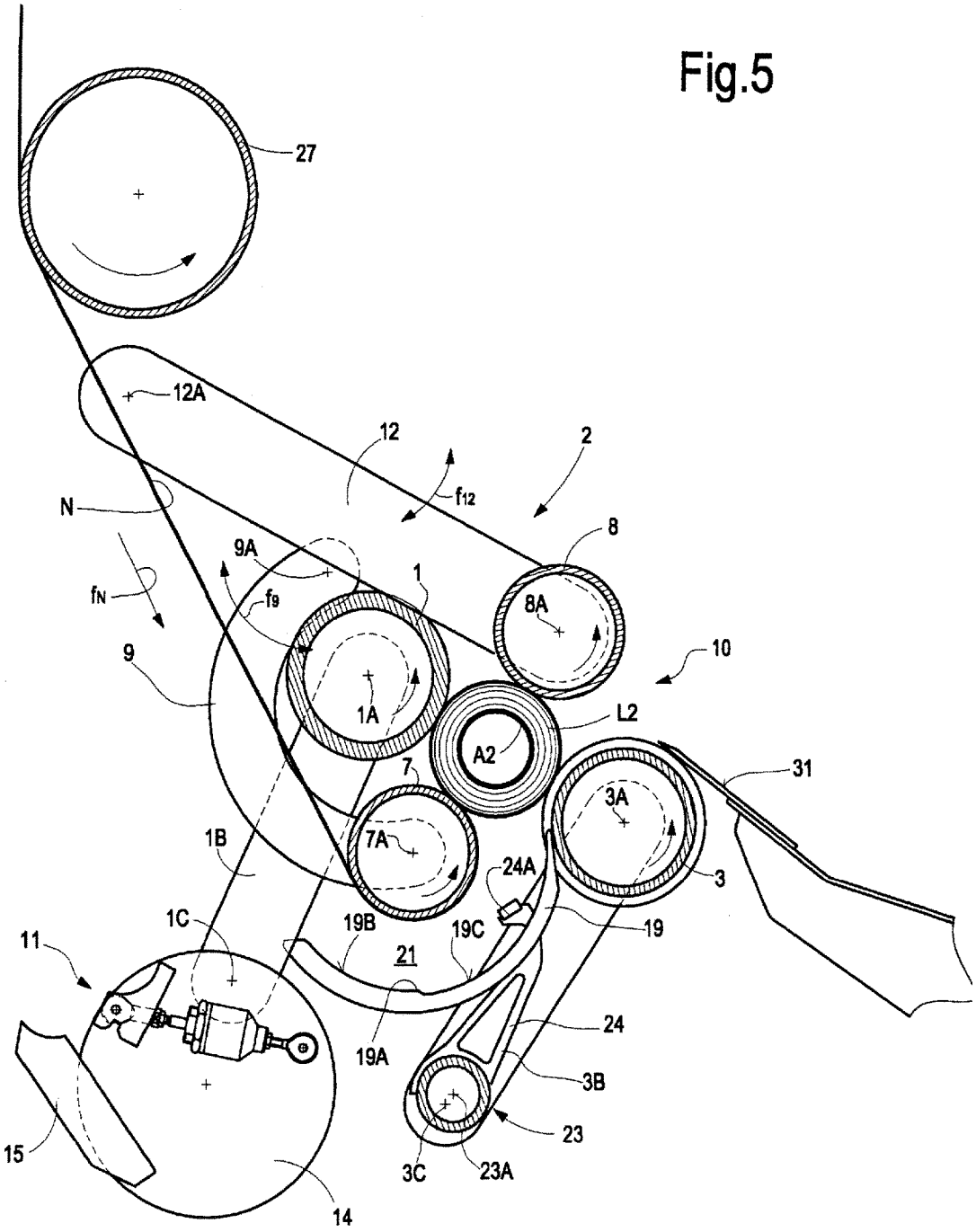

As it is shown in FIG. 5, which illustrates an intermediate step of the movement from the winding cradle 6 to the winding cradle 10, the center-to-center distance between the winding rollers 1 and 3 is gradually increased, so that the roll L2 may pass through the nip 5 towards the winding cradle 10. The fourth winding roller 8, that had been raised to allow growing of the roll L1 and unloading thereof towards the slide 31, has returned towards the nip 5 coming into contact with the roll L2, which moves forward through the nip 5. In this step the roll L2 may be in contact with all four winding rollers 1, 3, 7, and 8. The third winding roller 7 moves towards the nip 5 following the roll L2 up to make it pass beyond the area of minimum distance between the rollers 1 and 3. From this point the roll L2 may be in contact with the only rollers 1, 3, and 8, and winding thereof is completed in the second winding cradle 10.

The forward movement of the axis of the roll L2 may be suitably obtained by controlling the movement of the winding rollers, which, moving the reciprocal position of their axes, make the roll move forward in and through the area of minimum distance between the rollers 1 and 3. For instance, the forward movement may be obtained pushing the roll by means of the third winding roller 7. In some embodiments it is possible to facilitate, support or affect the movement of the roll by temporarily changing the peripheral speeds of the rollers, for instance by reducing for a short time the peripheral speed of the second winding roller 3.

While in the embodiment of FIG. 5 there is a step wherein the roll L2 is in contact with the four winding rollers 1, 3, 7, and 8, in other embodiments the third winding roller 7 may lose contact with the roll L2 before this latter passes through the nip 5, beyond the point of minimum distance between the winding rollers 1 and 3 and comes into contact with the fourth winding roller 8. However, in the illustrated embodiment the roll is better controlled during the various steps, as it is always in contact with at least three winding rollers.

The time the second winding core A2 remains in the position of FIG. 4, i.e. in the winding cradle 6, may be controlled simply by acting onto the peripheral speed of the winding rollers 1, 3, and 7 and/or onto the position of the rollers. The second winding core A2 will remain substantially in this position, without moving forward, for all the time the peripheral speeds of the winding rollers 1, 3, and 7 remains equal to one another. As mentioned above, the subsequent forward movement is obtained for instance by decelerating the second winding roller 3. It is therefore possible to set at will the quantity of web material N being wound around the winding core A2, holding this latter and the second roll L2 being formed around it in the winding cradle 1, 3, 7 for the desired time.

When the roll L2 is in the second winding cradle 10, the winding of the second roll L2 continues up to achieve the condition shown in FIG. 1. The third winding roller 7, that moved towards the nip 5 to follow the movement of the roll L2 through the nip in the second winding cradle 10, may return to the initial position of FIG. 1, where it cooperates with the severing member 23.

The conformation of the members of the rewinding machine is such that the path followed by the center of the winding cores A1, A2 from the time they come into contact with the two rollers 1, 3 up to the time the roll starts to be unloaded between the rollers 3 and 8 losing the contact with the roller 1, is substantially rectilinear. This allows a more regular winding and facilitates the use of centers that can be inserted in the opposite ends of the winding cores to improve control over the rotary and forward movement of the core and the roll during the winding cycle, combining the surface winding technique and an axial or central winding, as described for instance in U.S. Pat. No. 7,775,476 and in US-A-2007/0176039.

FIGS. 6 to 17 schematically show a further embodiment of a rewinding machine according to the present invention. Equal numbers indicate parts, elements or components equal or equivalent to those described with reference to FIGS. 1 to 5.

In this embodiment the machine, indicated as a whole with reference number 2, comprises a first winding roller 1 with a rotation axis 1A, arranged at the side of a second winding roller 3 having a rotation axis 3A. The axes 1A and 3A are substantially parallel to each other. Between the two winding rollers 1 and 3 a nip 5 is defined, through which a web material N is fed to be wound around winding cores A1, A2, around which logs or rolls L1, L2 are formed. Through the winding nip 5 pass also the winding cores A1, A2 that are inserted into the machine upstream of the nip 5 in a first winding cradle 6 formed by the first winding roller 1, by the second winding roller 3 and by a third winding roller 7, rotating around an axis indicated again with 7A.

The winding cores end receiving the web material N wound around them when they are in a second winding cradle 10 arranged downstream of the nip 5 formed by the first winding roller 1, the second winding roller 3 and a fourth winding roller 8. The rotation axis of the fourth winding roller 8 is indicated with 8A. Reference number 12 indicates a pair of arms hinged at 12A and supporting the fourth winding roller 8. The arrow f12 indicates the pivoting movement, i.e., the movement of reciprocating rotation of the arm 12, and consequently of the fourth winding roller 8.

The third winding roller 7 is provided with a movement towards and away from the winding nip 5. In some embodiments the third winding roller 7 is supported by a pair of arms 9 pivoted around an axis 9A to rotate in a reciprocating manner according to the double arrow f9.

The path of the web material N extends around the third winding roller 7 and around the first winding roller 1, forming, during some steps of the winding cycle (see for instance FIG. 6), a portion of web material between the two rollers 7 and 1.

Upstream of the winding nip 5, of the first winding roller 1 and of the second winding roller 3 a core feeder 11 is arranged, that can be designed in any adequate manner.

In some embodiments the rewinding machine comprises a rolling surface 19 for the winding cores. The rolling surface 19 may have an approximately cylindrical shape, approximately coaxial with the third winding roller 7, when this roller is in the position of FIG. 6. The length of the rolling surface 19, i.e., the extension thereof along the feed path for the web material, is substantially smaller than that of the surface 19 of the embodiment described with reference to FIGS. 1 to 5. It may be formed, in this case again, by two portions 19B and 19C. Each portion 19B, 19C of the rolling surface or at least one of them may be defined by shaped sheets, parallel to one another and to the figure plane. Also in this case, the rolling surface is formed by the curved edges, parallel to one another and facing the third winding roller 7, of the single plates.

The rolling surface 19 and the cylindrical surface of the third winding roller 7 form a feeding channel 21 for the winding cores A1, A2. When the third winding roller 7 is in the position of FIG. 6, the height of the feeding channel 21 for the winding cores is smaller in the first channel portion, corresponding to the portion 19B of the rolling surface 19, and greater in the second portion of the feeding channel 21, corresponding to the portion 19B of the rolling surface. This change in the height of the feeding channel 21 facilitates the rotation of each new winding core A1, A2 inserted in the feeding channel 21, as it will be explained below.

The rewinding machine 2 comprises a severing member cooperating with the third winding roller 7 and more exactly arranged and controlled to interact with the web material that is in the portion comprised between the third winding roller 7 and the roll being formed, as it will be better described in greater detail with reference to the sequence of FIGS. 6 to 17.

In this embodiment again, the severing member is indicated as a whole with number 23. It comprises a linear element 53, for instance a suitably tensioned wire or a cable, or a substantially rigid linear element, arranged according to a line as similar as possible to a straight line, preferably nearly parallel to the axes of the winding rollers 1, 3, 7, and 8 and that has a limited tendency to bending deformation under the effect of the dynamic stresses due to its working movement, described below.

The linear element 53 is provided with a motion according to an actuating trajectory orthogonal to the longitudinal extension of said linear element and intersecting the path of the web material, in an area comprised between the winding rollers 1 and 7 or more in general between the winding roller 7 and the roll in the final phase of the winding cycle.

In some embodiments, the linear element 53 is carried by a pair of arms 51 pivoting around a pivoting axis 51A, so as to move the linear element 53 according to the double arrow f53, in the way and for the purposes described in greater detail below.

Figure 6:
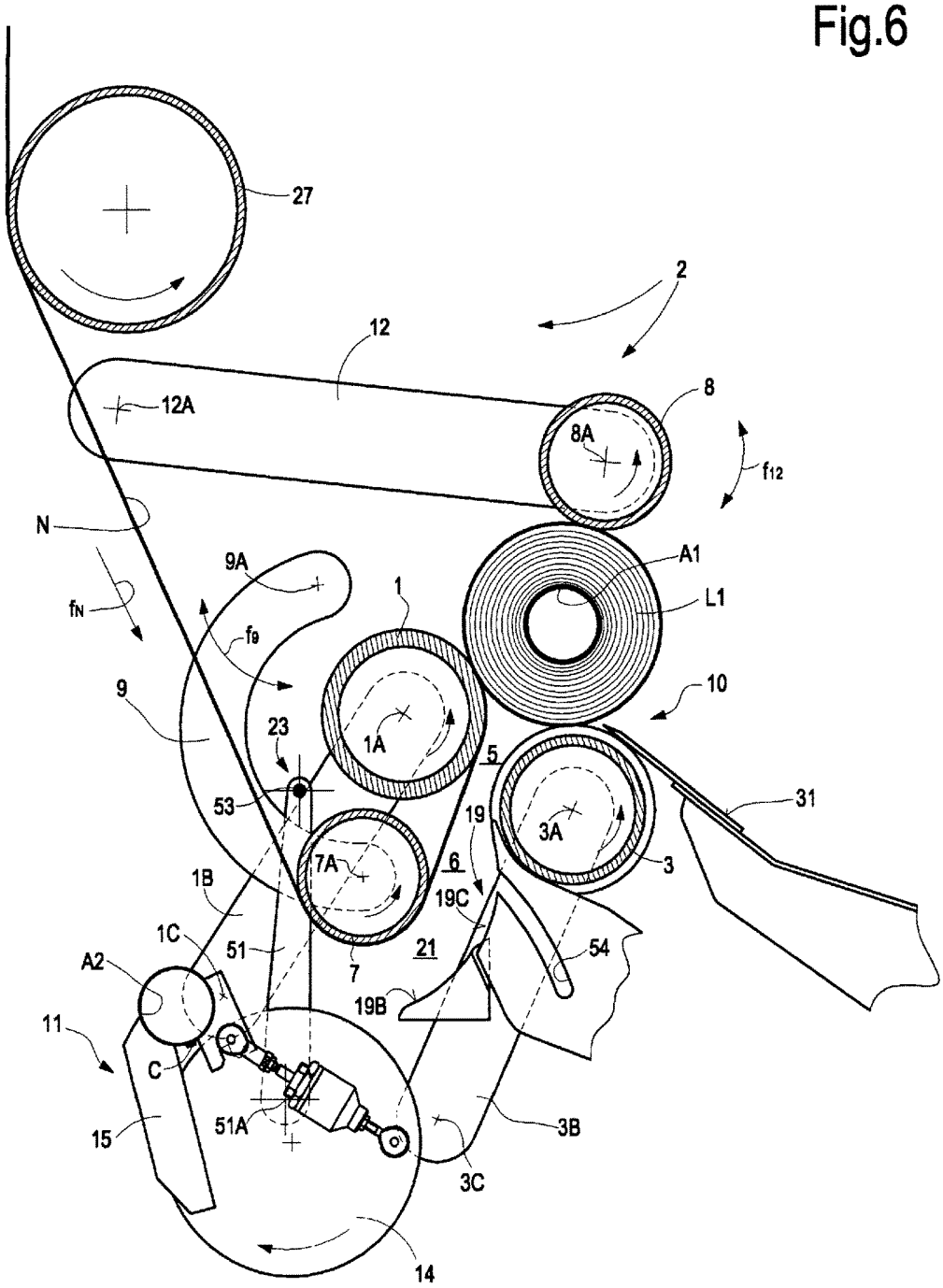
FIGS. 6 to 17 schematically show a further embodiment of a rewinding machine according to the invention in a double operating sequence.
Figure 12:
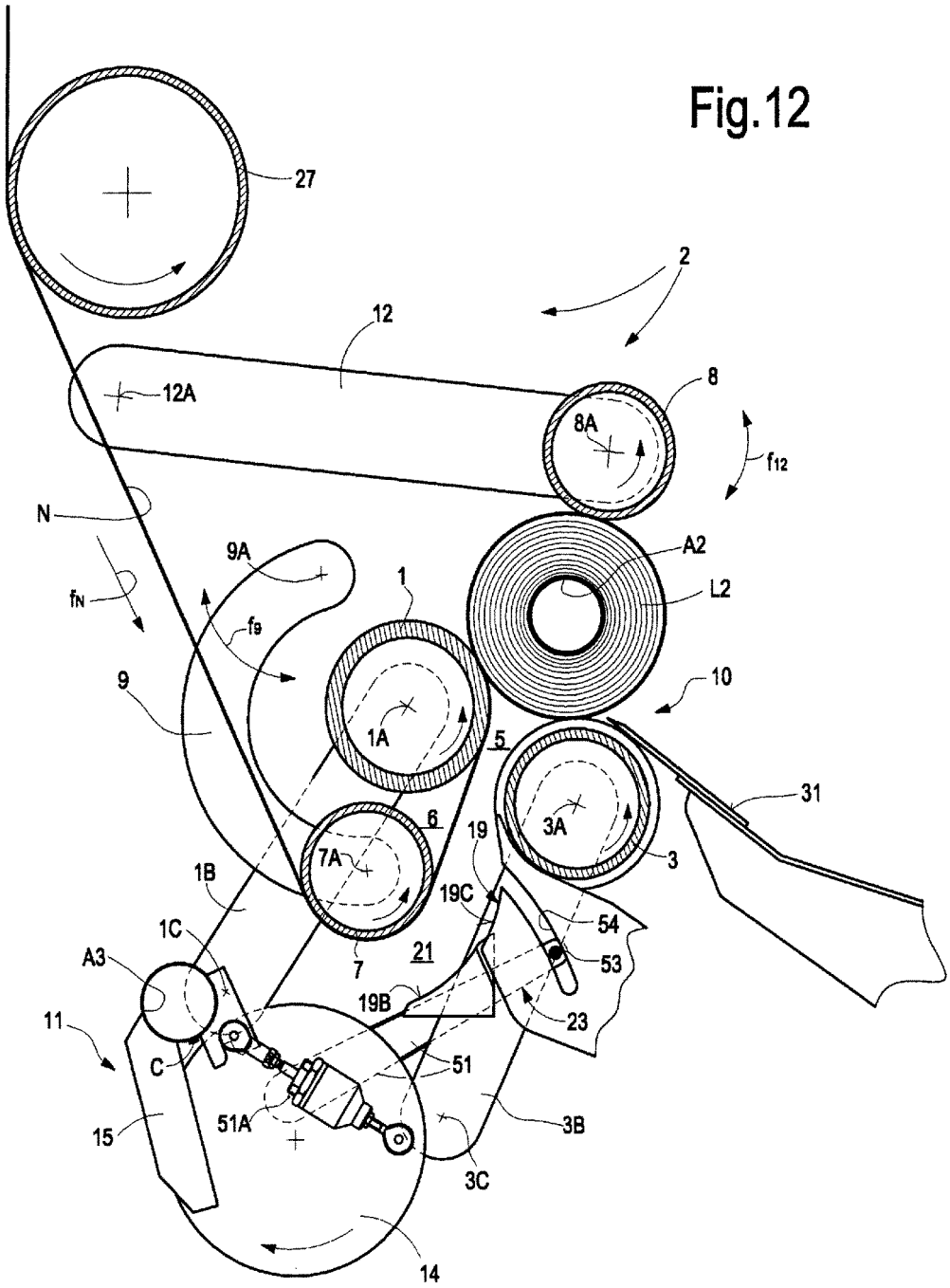

The severing member 23 can move along a trajectory extending between two end or rest positions, one of which is shown in FIG. 6 and the other one is shown in FIG. 12.

FIG. 6 shows a final step of the winding cycle of a first roll or log L1. During this step of the winding cycle the roll L1 is in the second winding cradle 10 in contact with the first winding roller 1, the second winding roller 3 and the fourth winding roller 8. The web material N is fed according to the arrow fN around the third winding roller 7 and around the first winding roller 1, and is wound on the roll L1 that is rotated by means of the rollers 1, 3, and 8 and is held by them in the winding cradle 10. Reference 27 indicates a guiding roller for the web material N arranged upstream of the winding head defined by the winding rollers 1, 3, 7, and 8. Preferably, the feed speed of the web material N is substantially constant.

At least while the roll L1 is being wound, outside of the so-called exchange phase, which is a transitory phase in the operation of the machine, the peripheral speeds of the winding rollers 1, 3, 7, and 8 are substantially equal to one another and all the various winding rollers rotate in the same direction, as indicated by the arrows in the drawing. "Substantially equal" means in this case that the speeds may vary only according to the needs for controlling the compactness of the winding and the tension of the web material N between the winding roller 7 and the winding roller 8, for instance to balance the change in tension that could be caused by the displacement of the center of the roll being formed along the path between the winding rollers, as well known. Furthermore, the peripheral speeds may vary slightly to cause or facilitate the forward movement of the roll being formed, as explained below, so as to facilitate the passage thereof from the first winding cradle 6 to the second winding cradle 10. Changes in speed may be useful to facilitate or cause the passage of the roll through the nip 5 and to unload the roll from the second winding cradle, as known to those skilled in the art.

The sequence of FIGS. 6 to 17 shows two subsequent steps of severing or cutting of the web material when the winding of respective logs or rolls L is finished.

In FIG. 6 a first roll L1 is finishing to be wound around a first winding core A1, while the second winding core A2, engaged by the feeder 15, is ready to be inserted into the winding head. The severing member 23 is arranged so that the linear element 53 is on one side of the feed path of the web material between the winding rollers 1 and 7, and more precisely on the side opposite that on which the channel 21 for inserting the winding cores is located.

Figure 7:
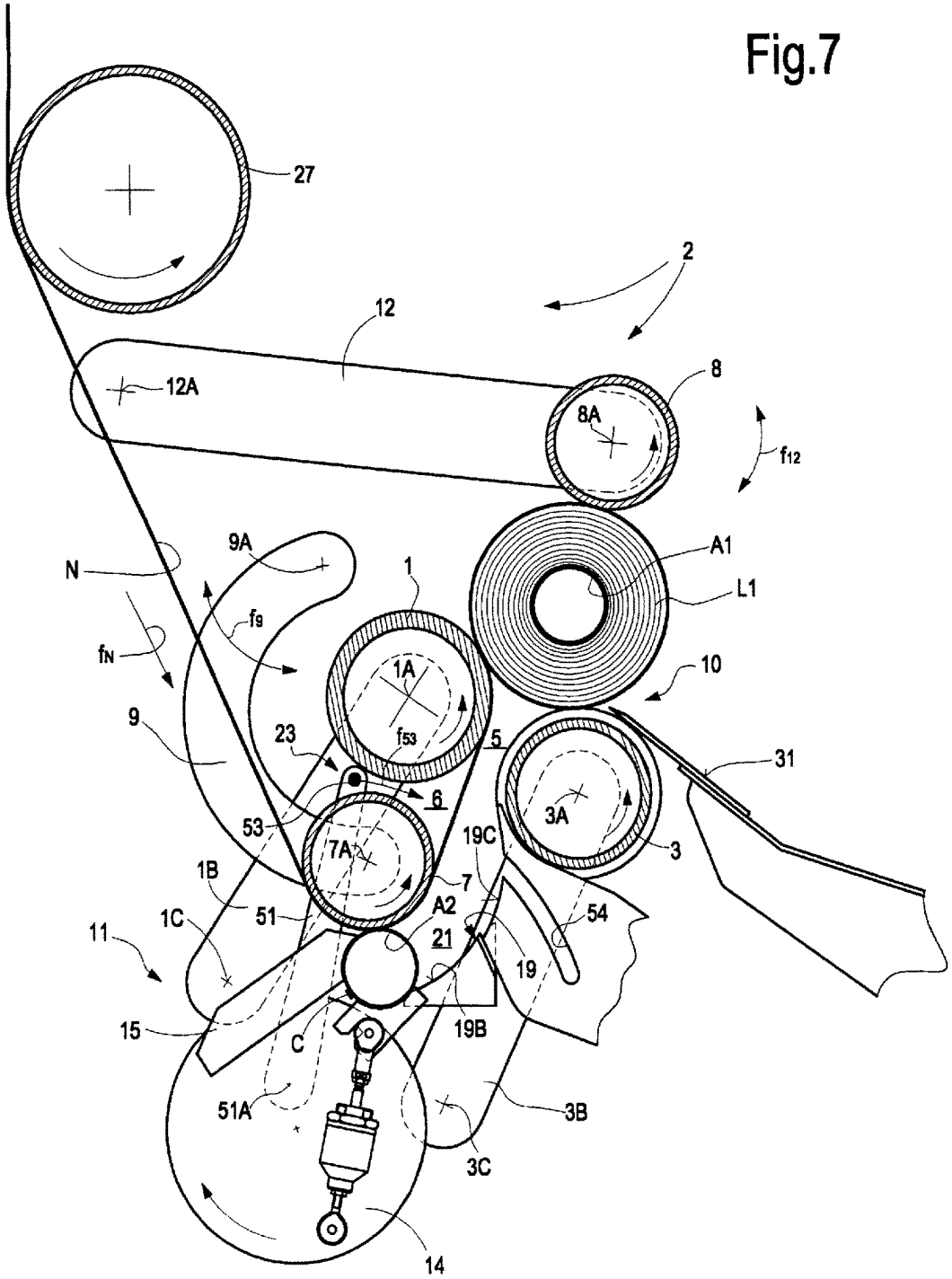

FIG. 7 shows the start of the motion of the severing member 23 according to the arrow f53. The arrangement is such that the linear element 53 moves through the nip or space between the first winding roller 1 and the third winding roller 7 to gradually move towards the web material N in the portion comprised between the first winding roller 1 and the third winding roller 7.

In FIG. 7 the tubular winding core A2, inserted into the channel 21 by the core feeder 15, is pushed between the portion 19B of the rolling surface 19 and the third winding roller 7. In this initial portion of the channel 21 defined by the portion 19B of the rolling surface 19, the height of the channel 21 is preferably smaller than the diameter of the tubular core A2. This latter is made of a flexible material, for instance cardboard, plastic or the like, so that it can be elastically deformed due to pressure, as shown in the subsequent step of FIG. 8 while it is accelerated angularly and starts to roll on the rolling surface 19.

Figure 8:
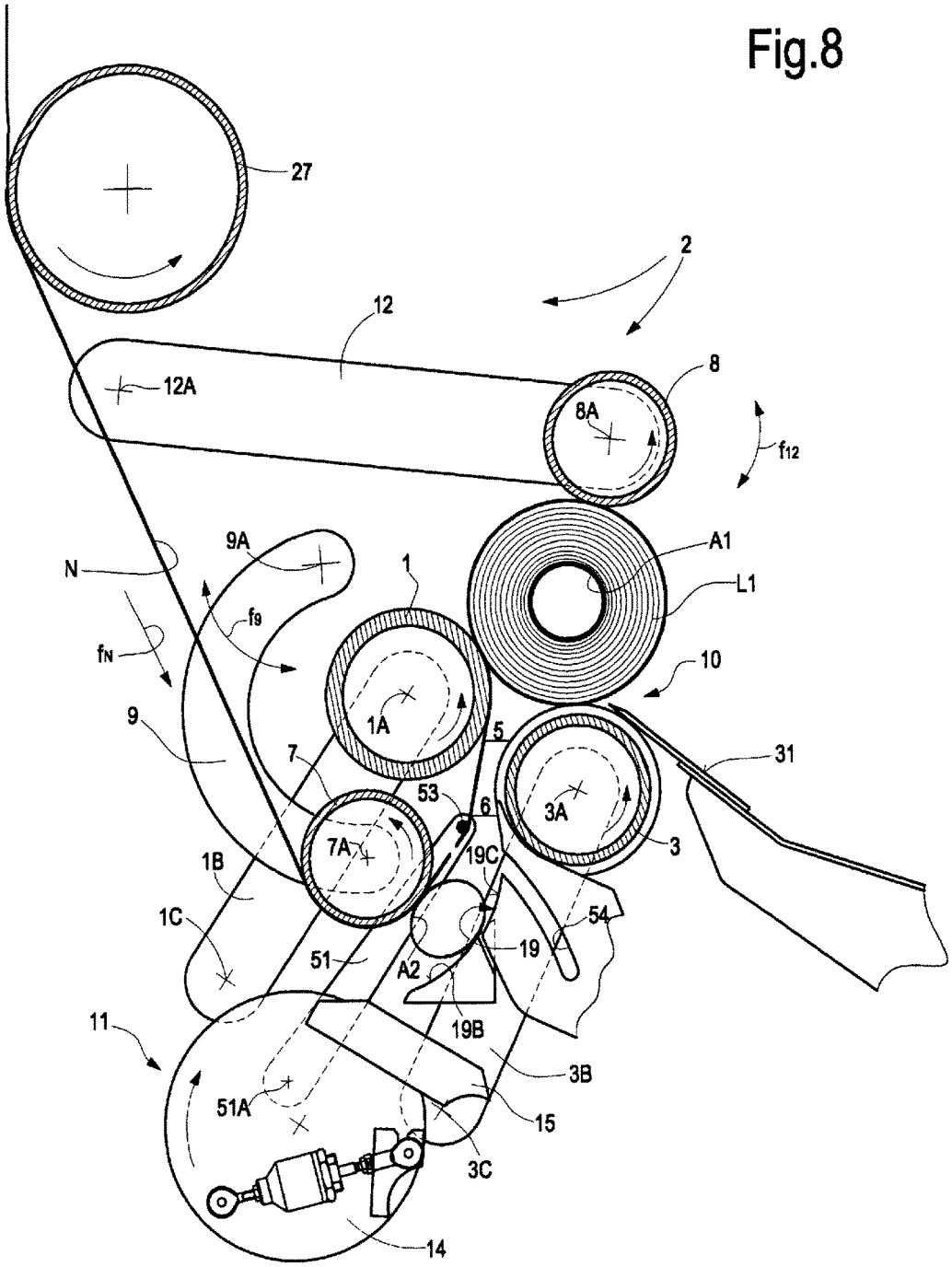

FIG. 8 shows a subsequent instant when the linear element 53 of the severing member 23 starts contacting the web material N and moves beyond the plane tangent to the first winding roller 1 and to the second winding roller 7, that is the plane defining the normal fed path for the web material N. In FIG. 8 the web material N is shown in a displaced position with respect to its normal feed path, due to the push exerted thereon by the linear element 53.

A line of glue C applied onto the outer surface of the tubular core A2 comes into contact with the web material in the portion entrained around the third winding roller 7, due to the effect of the start of the rolling movement of the tubular core A2 on the rolling surface 19.

Figure 9:
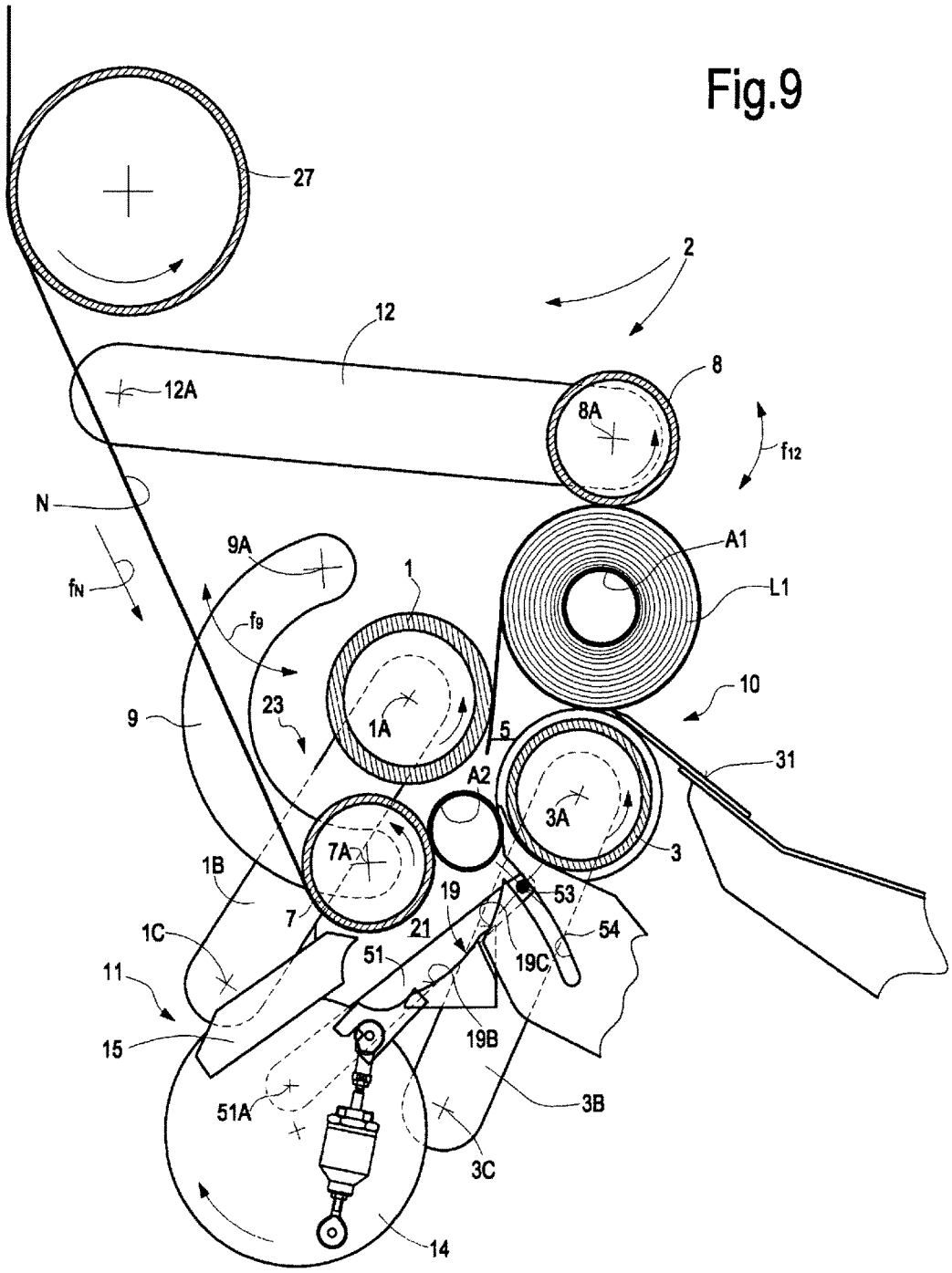

In FIG. 9 the linear element 53 of the severing member 23 has moved beyond the rolling surface 19 and, cooperating with the third winding roller 7 around which the web material is driven and against which said material is pinched by means of the new tubular winding core A2, has completed the severing of the web material N. This latter starts to be wound on the new tubular core A2 to which it adheres thanks to the glue C. The linear element 53 of the severing member 23 continues to move downwards (in the figures) achieving a rest position, i.e. an idle position, on the side of the rolling surface opposite the side where the core inserting channel 21 is located. To this end, in some embodiments a seat 54 may be provided, formed for instance by a notch or groove provided in each of the plates forming the rolling surface 19 or more exactly the portion 19C of the rolling surface.

Figure 10:
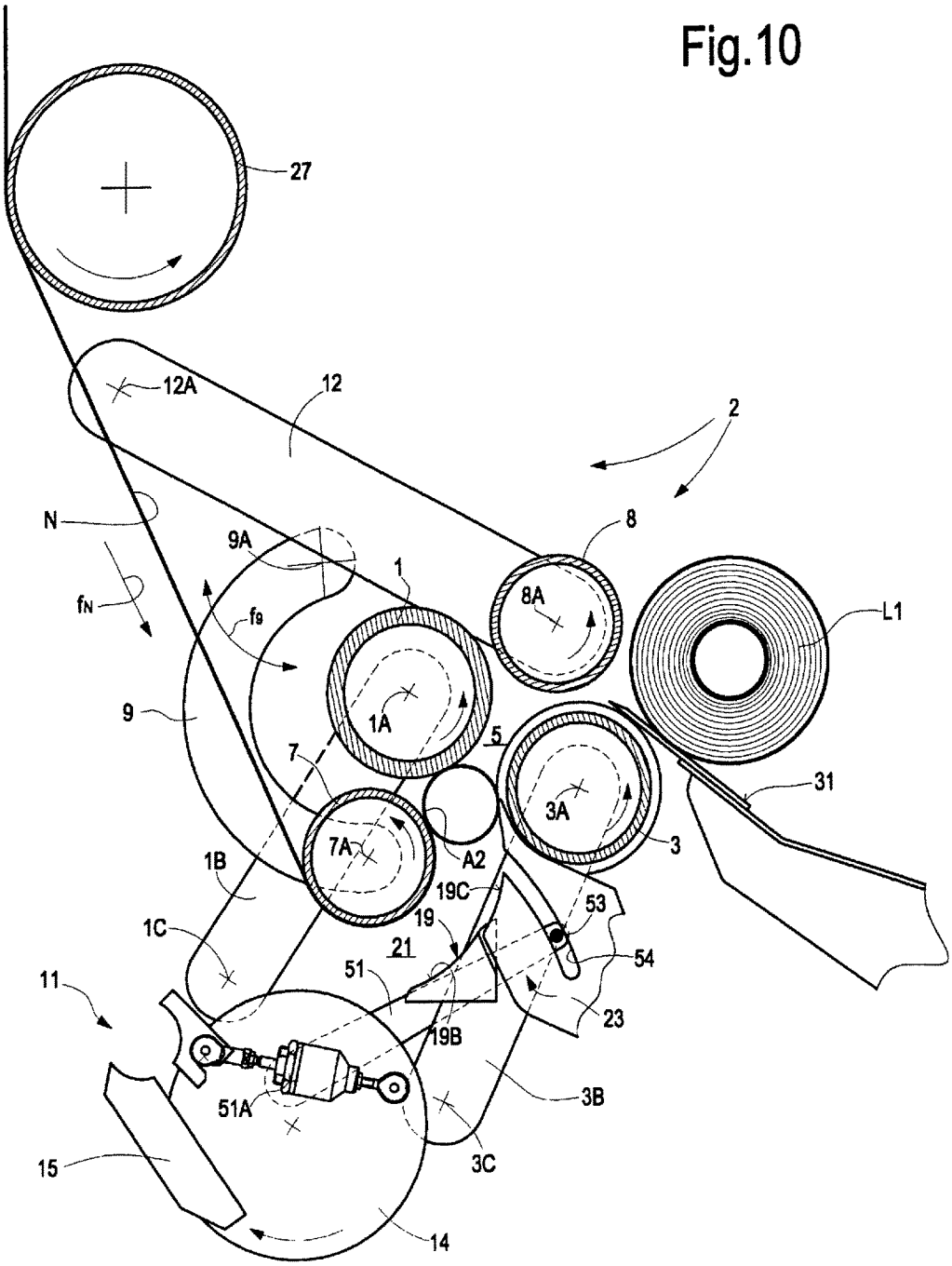

FIG. 10 shows the phase in which the linear element 53 is completely housed inside the seat 54. The tubular winding core A2, with the first turns of web material N wound around it, is engaged in the first winding cradle defined by the winding rollers 1, 3, and 7 and is held in this position for a given time, so as to start a first winding step. The fourth winding roller 8 has been moved away from the nip 5 between the first winding roller 1 and the second winding roller 3, to allow the ejection of the first roll or log L1 that has been completely formed around the winding core A1 and moves therefore on the slide 31 to exit from the second winding cradle formed by the winding rollers 1, 3, and 8. The ejection may be performed by suitably changing the peripheral speeds of the winding rollers, as known to those skilled in the art.

Figure 11:
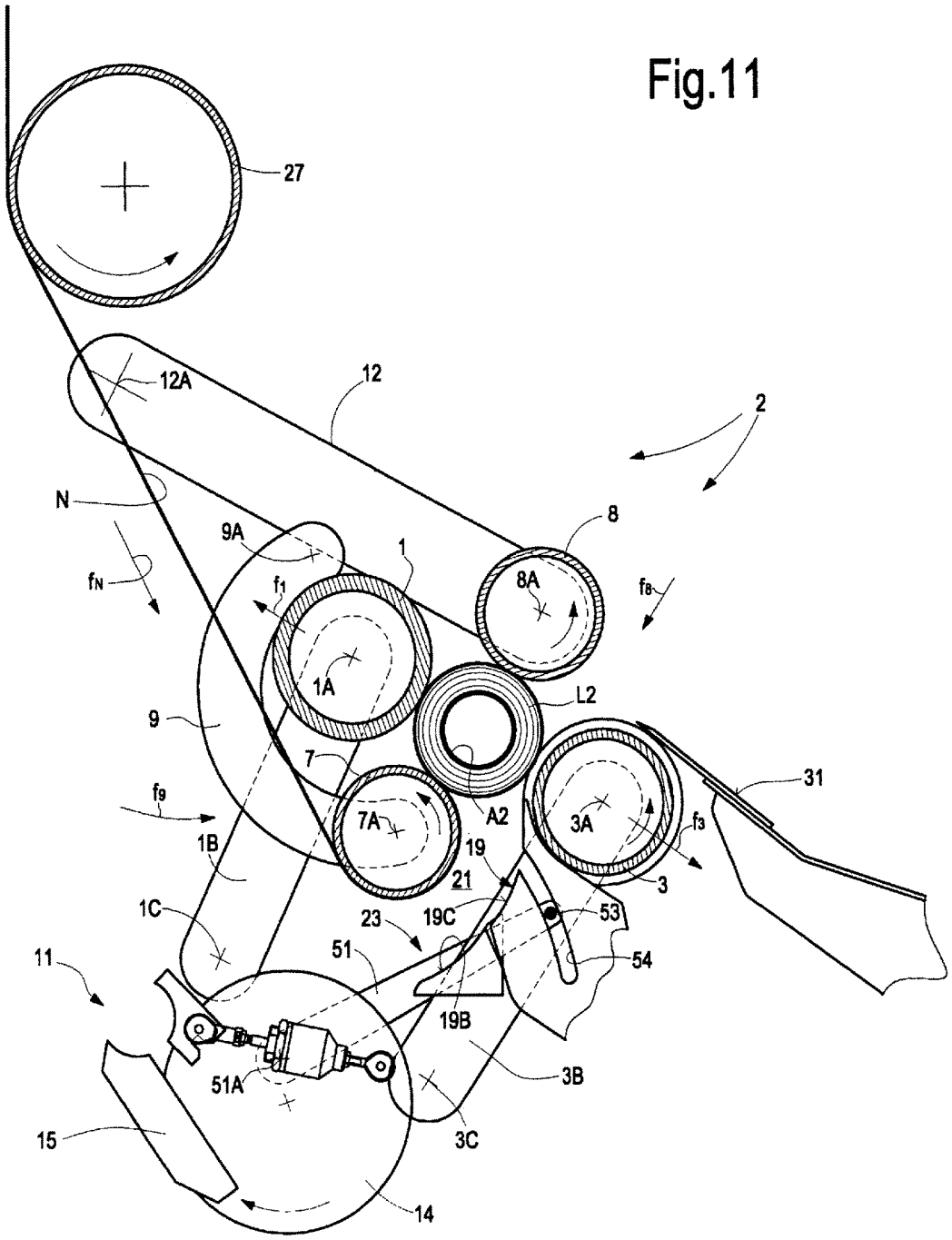

In FIG. 11 the first and the third winding roller 1, 3 have been moved mutually away from each other to allow the passage of the second winding core A2, with the roll or log L2 partially formed there around, through the nip 5 formed between the first winding roller 1 and the second winding roller 3. The arrows f1 and f3 represent the movement of the two winding rollers 1 and 3 away from each other. In alternative embodiments only one of the two winding rollers 1, 3 is movable to allow the enlargement of the nip 5 and the passage of the new roll L2 through it. As mentioned above with reference to FIGS. 1 to 5, the symmetrical movement of the two winding rollers 1 and 3 away from each other has the advantage of allowing the winding core A2 to follow a substantially rectilinear path, so as it may be guided in a simple manner by centers (not shown) during at least one portion of the winding cycle.

In this phase of the winding cycle the third winding roller 7 moves due to the effect of the rotation of the arms 9 around the pivot 9A (arrow f9) to follow the movement of the roll L2 during the passage through the nip 5. In this way the second roll L2 is wound in contact with three winding rollers 1, 3, 7.

After the first roll L1 has been ejected from the second winding cradle, the fourth winding roller 8 has been lowered (arrow f8) to take contact with the second roll L2 while this moves through the nip 5 or when it has passed the nip 5 to enter the second winding cradle between the rollers 1, 3, and 8. In the phase illustrated in FIG. 11, in this embodiment the roll L2 is therefore in contact with the four winding rollers 1, 3, 7, and 8.

The forward movement of the new roll L2 through the nip 5 between the first winding roller 1 and the third winding roller 3 may be provided by changing the peripheral speeds, for instance by slowing the second winding roller 3, or may be facilitated by this change in speed, in combination with the mutual movement of the rollers 1, 3,7.

Once the roll L2 has passed through the nip 5, the winding members take the position of FIG. 12, where the roll L2 is in the second winding cradle, in contact with the winding rollers 1, 3, and 8, while the third winding roller 7 has, in this step, the only function of guiding and driving the web material N fed substantially continuously at substantially constant speed in the winding cradle between the winding rollers 1, 3, and 8. The severing member 23 remains in the position of FIG. 11, with the linear element 53 inside the seat 54.

Figure 13:
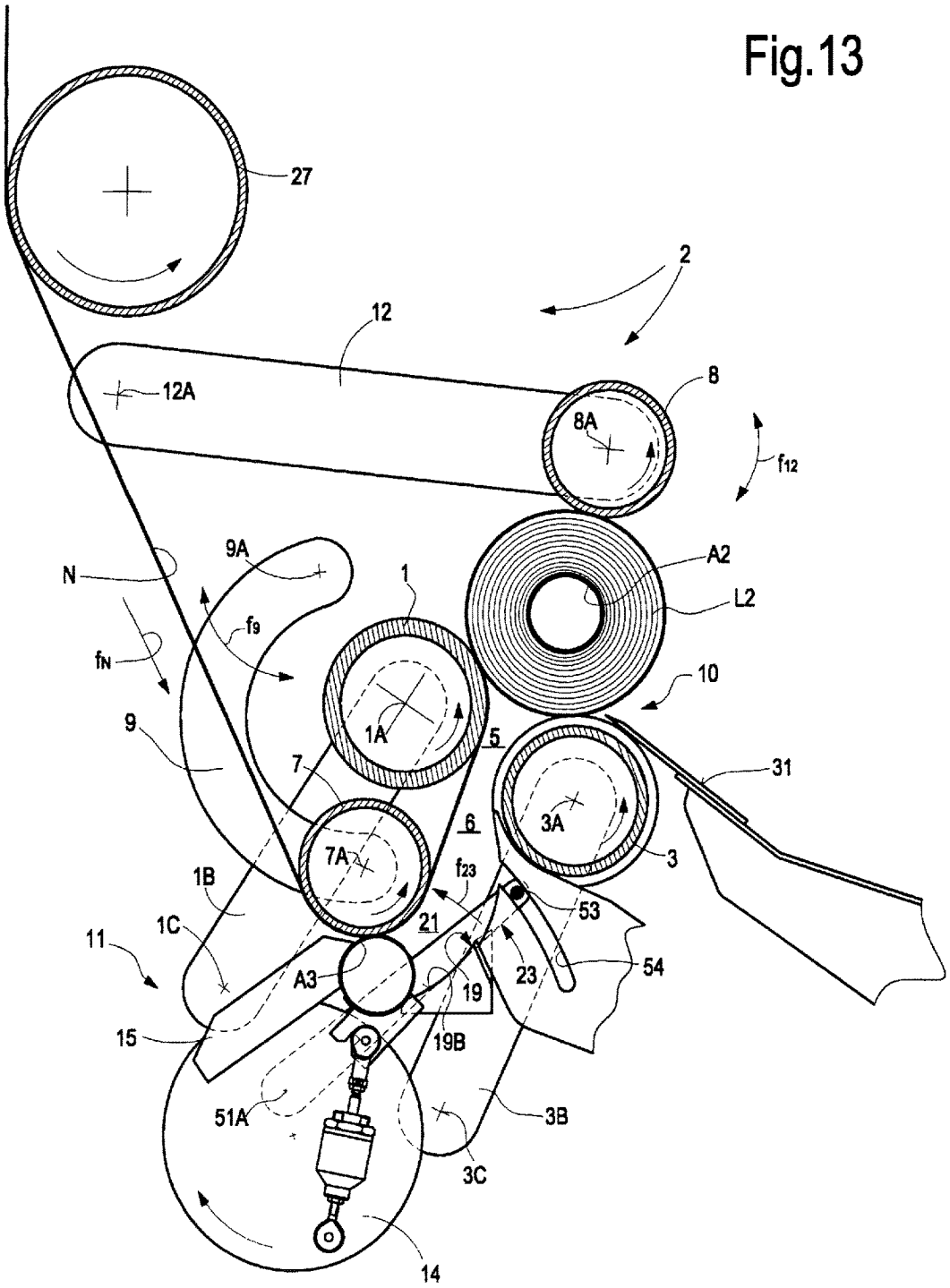

FIG. 13 illustrates a step of inserting a third tubular winding core A3, while winding of the second roll or log L2 around the second winding core A2 is completed in the second winding cradle 1, 3, 8. In FIG. 13 the winding rollers have substantially the same position as in FIG. 7, while the severing member 23 starts an upward movement (in the figure) according to the arrow f23, to interfere with the web material N from the side opposite to the side from which it has started severing the web material in the previous cycle (FIGS. 7 and 8).

Figure 14:
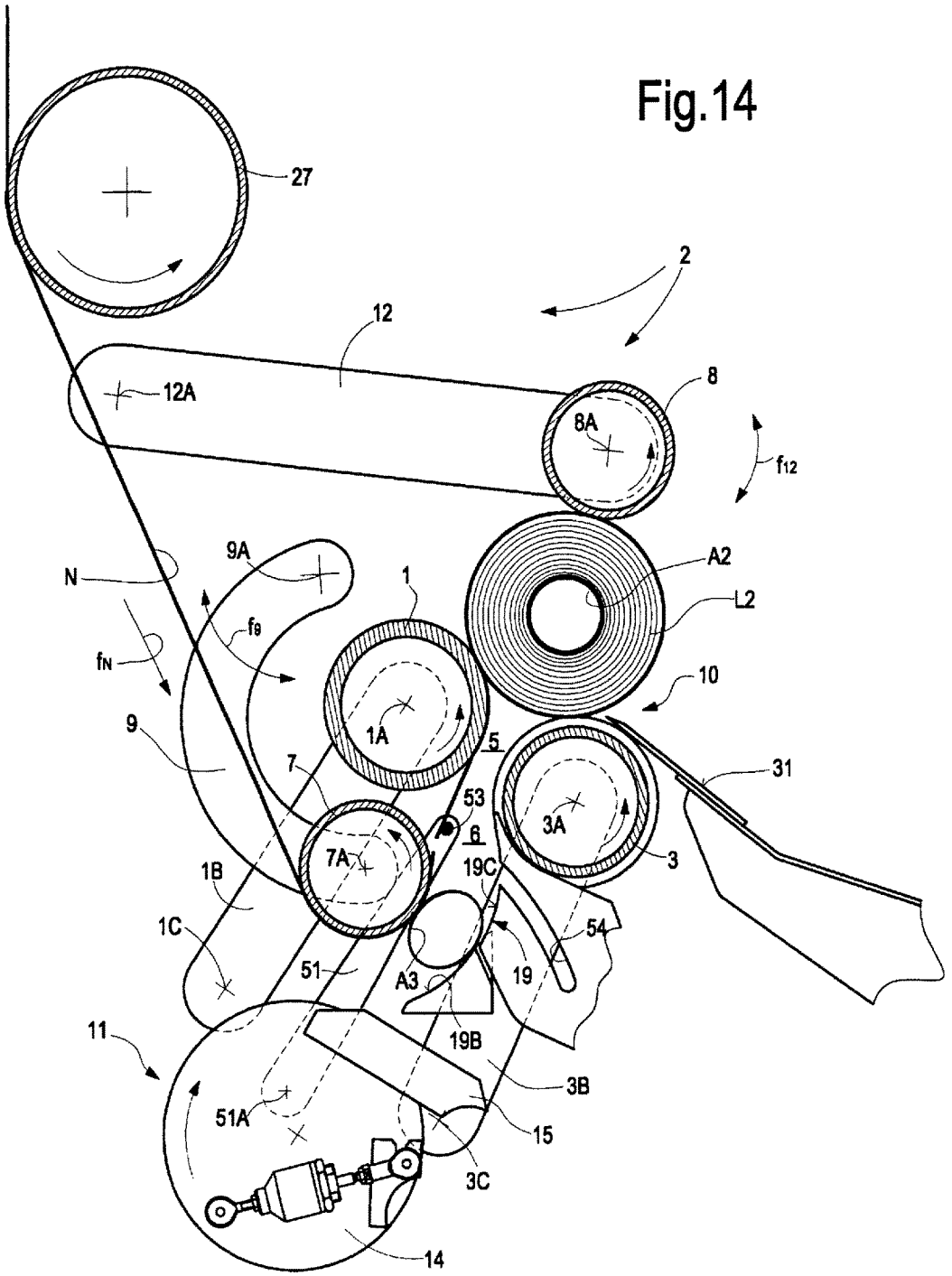

In FIG. 14 the new winding core A3 starts to rotate and to roll on the surface 19 in the channel 21, similarly to what is illustrated in FIG. 8, while the severing member 23 has moved to such a position that the linear element 53 interferes with the feed path for the web material in the portion comprised between the first winding roller 3 and the third winding roller 7.

Figure 15:
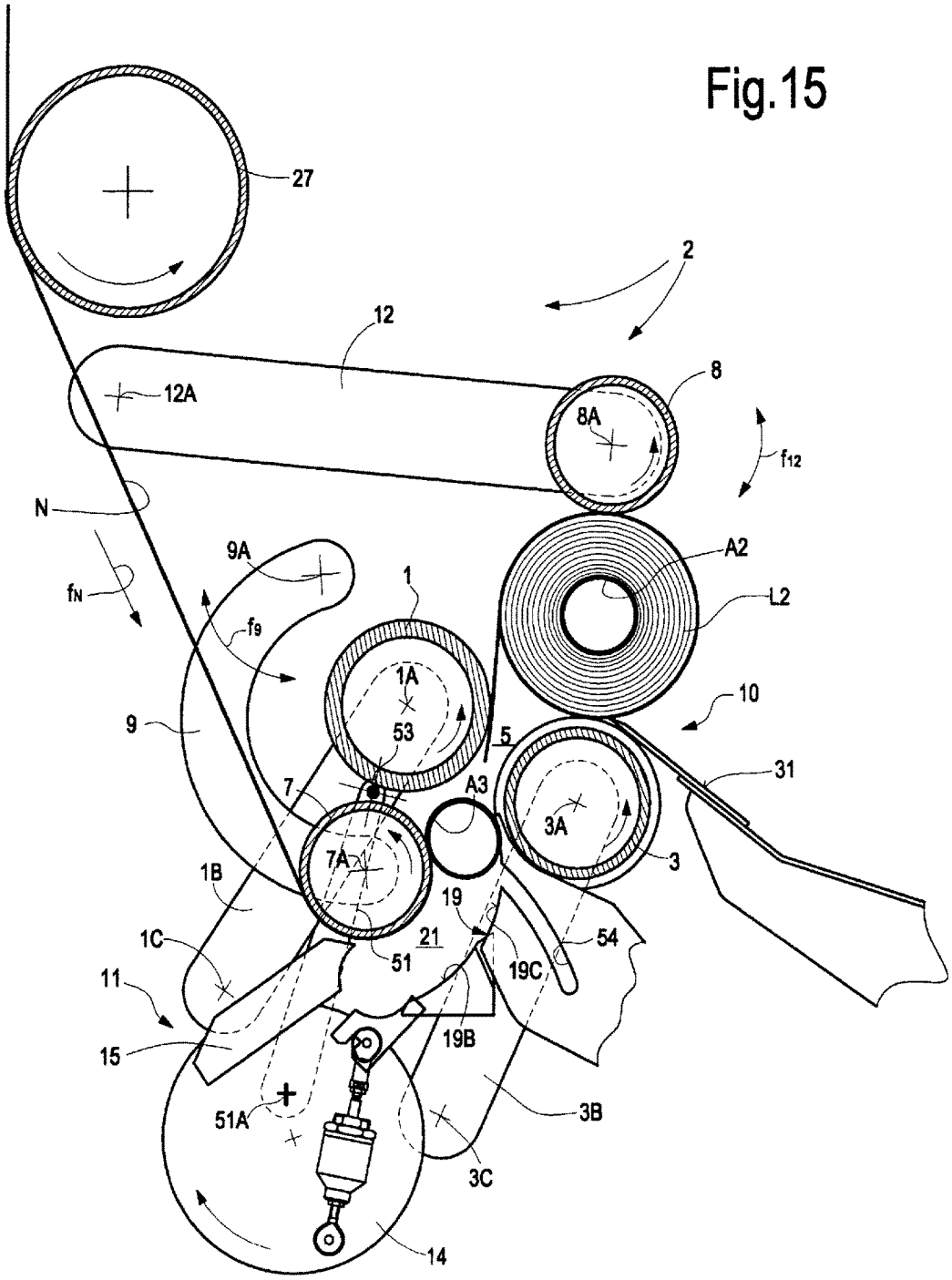

In FIG. 15 the web material N has been severed or cut due to the effect of the linear element 53 acting thereon and cooperating with the third winding roller 7 onto which the new winding core A3 pushes, thus pinching the web material N. The leading part of the web material starts to be wound around the winding core A3 due to the effect of the glue C applied on the winding core A3. Similarly to the step illustrated in FIG. 9, the winding core, with the first turns of web material N wound around it, moved forward rolling on the surface 19 and is now in contact with the second winding roller 3 and the third winding roller 7.

The linear element 53 continues its movement passing through the nip formed by the first winding roller 1 and the third winding roller 7, up to the final rest position (FIG. 16) from which it starts moving to perform the subsequent severing cycle of the web material N. The roll L2 is still in the second winding cradle, but, similarly to what is illustrated in FIG. 9, it begins its ejection movement, moving away from the first winding roller 1 and remaining still in contact with the second winding roller 3 and the fourth winding roller 8.

Figure 16:
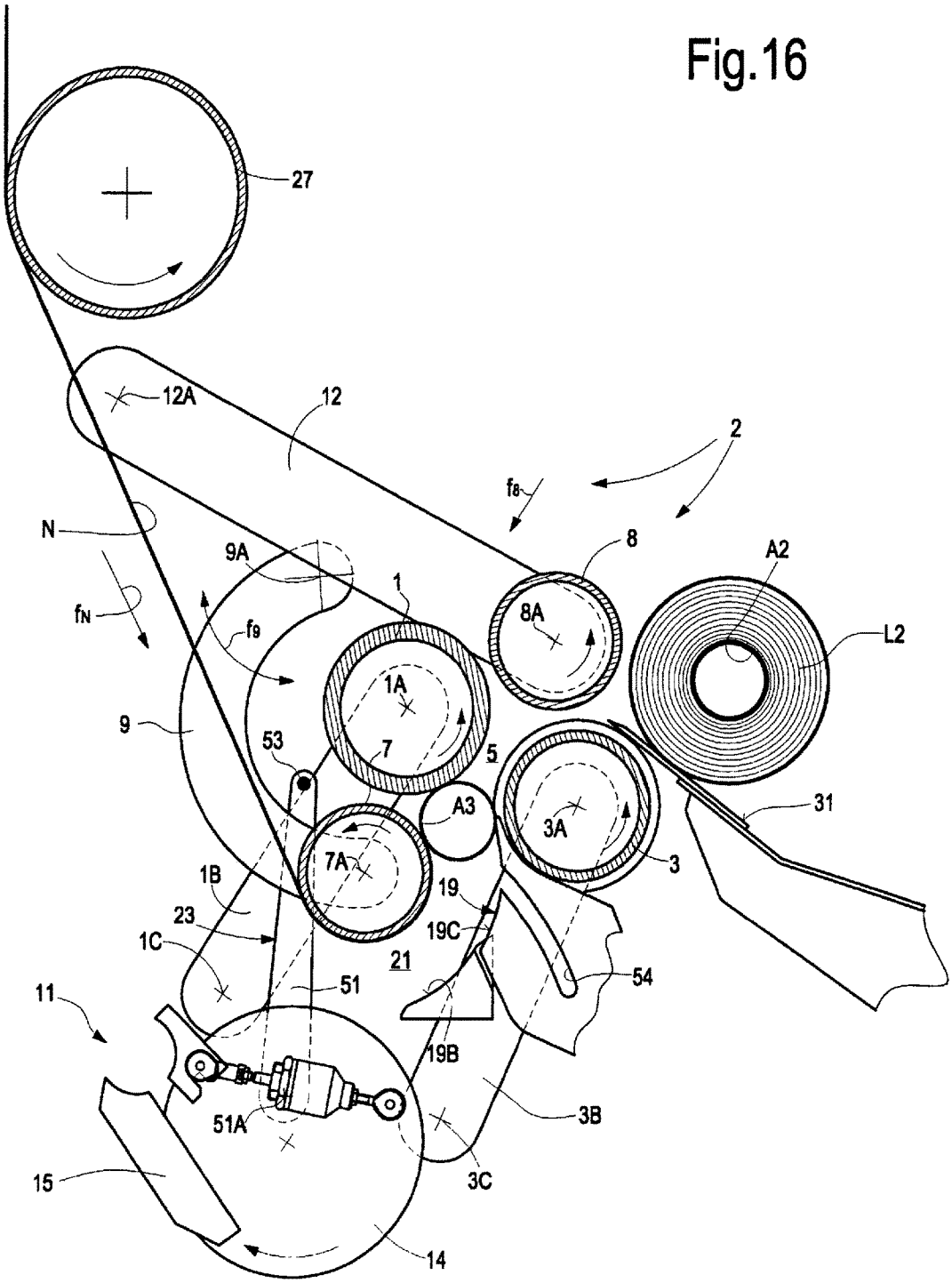

In FIG. 16 the second log or roll L2 wound around the second winding core A2 has been completely ejected from the second winding cradle and is ejected, rolling on the slide 31, while the fourth winding roller 8 moves (arrow f8) towards the nip 5 between the first winding roller 1 and the second winding roller 3. The third winding roller 7 is moving towards the nip 5 and the third roll being formed around the third winding core A3 is now in contact with the three winding rollers 1, 3, and 7 forming the first winding cradle.

Figure 17:
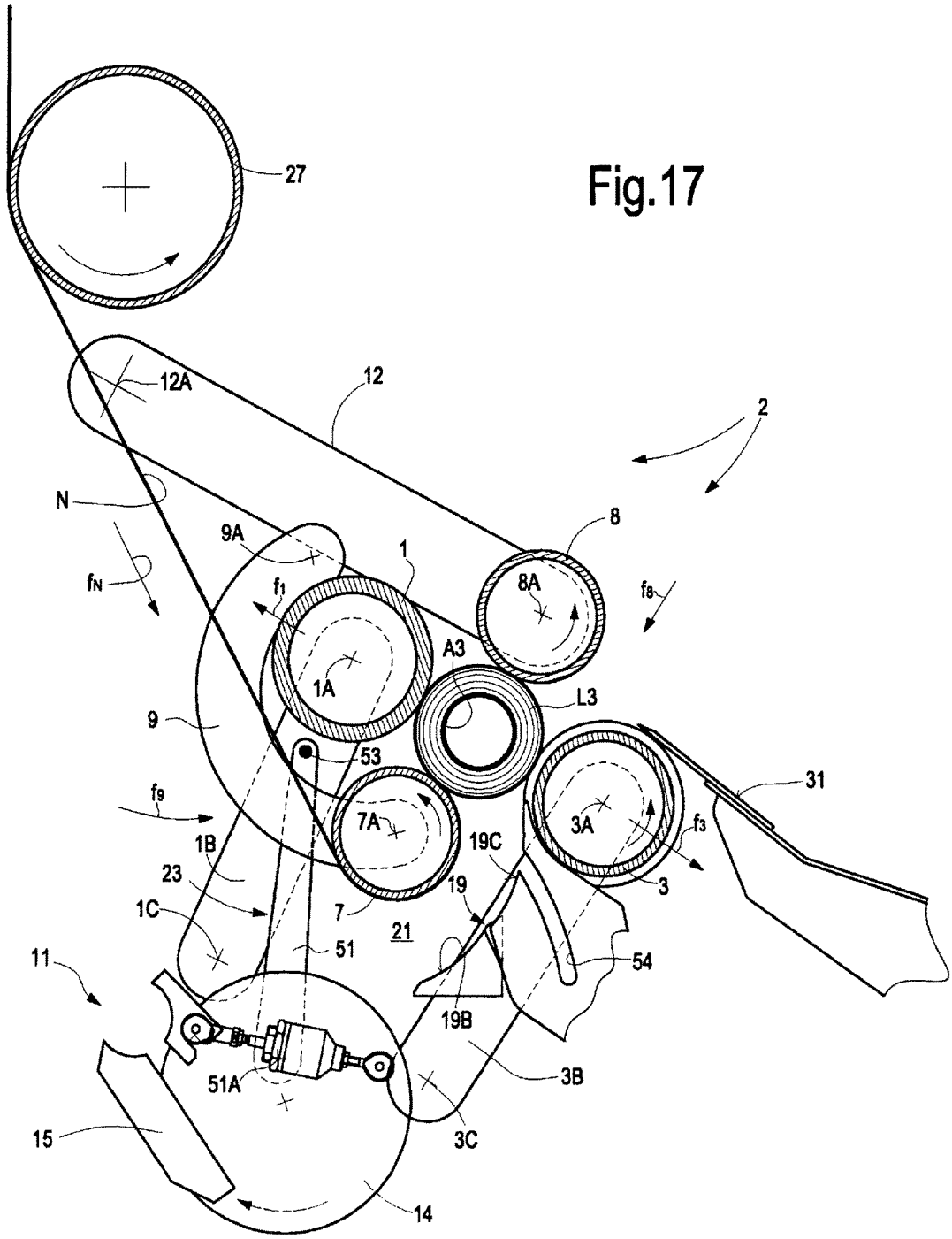

In the subsequent FIG. 17 the winding members have returned to the position of FIG. 11 and the third roll or log L3 being wound around the third winding core A3 is moving through the nip 5, that has been enlarged due to the effect of the mutual movement of the first winding roller 1 and the second winding roller 3 away from each other. Winding in this step is performed between the four winding rollers in contact therewith, as illustrated above with reference to FIG. 11.

From FIG. 17 the cycle continues according to the sequence of FIGS. 6 to 10 to complete the winding of the third roll L3 and start the winding of a subsequent roll around a fourth winding core inserted into the machine.

In the embodiment illustrated in FIGS. 6 to 17, the channel 21 for inserting the cores and the rolling surface 19 are smaller than in the embodiment of FIGS. 1 to 5. The gluing point, i.e., the point where the web material N adheres on each new winding core, is therefore nearer to the leading edge of the web material that has been formed by severing by means of the linear element 53. This results in a higher quality of winding, that is more regular and has less wrinkles and an initial fold of the paper on the core which is shorter than the one that can be obtained with the arrangement of FIGS. 1 to 5.

Furthermore, as it is clearly apparent by comparing the sequence of FIGS. 6 to 9 and the sequence of FIGS. 1 to 3, the quantity of web material N wound around each winding core A1-A3 before this latter loses the contact with the rolling surface 19 and starts winding in the first winding cradle in contact with the first winding roller 1, the second winding roller 3 and the third winding roller 7 is substantially smaller in the embodiment of FIG. 6 and the following than in the embodiment of FIGS. 1 to 5. As the quality of the winding performed in contact with three winding rollers is higher than the quality of the winding performed when the roll is also in contact with the rolling surface 19, in the embodiment of FIGS. 6 to 17 a better quality of winding and a greater regularity of the web material wound also in the more internal part of each roll is achieved.

It is understood that the drawing only shows an example provided by way of a practical arrangement of the invention, which can vary in forms and arrangement without however departing from the scope of the concept underlying the invention. Any reference numerals in the appended claims are provided to facilitate reading of the claims with reference to the description and to the drawing, and do not limit the scope of protection represented by the claims.

The invention claimed is:

1. A method for winding a web material and forming in sequence rolls of said web material wound around winding cores, comprising arranging four winding rollers to define a first winding cradle between a first winding roller, a second winding roller and a third winding roller, and to define a second winding cradle between said first winding roller, said second winding roller and a fourth winding roller; performing a first part of a winding cycle of each roll in the first winding cradle, and a subsequent part of the winding cycle of each roll in the second winding cradle, the roll being wound passing from the first winding cradle to the second winding cradle through a nip defined between the first winding cradle and the second winding cradle; wherein once a roll has been completely wound, severing the web material by a movable severing member acting between the third winding roller and the roll being formed in the second winding cradle, wherein the severing member acts against the surface of the third winding roller.

2. The method according to claim 1, further comprising pinching the web material by the severing member against the third winding roller causing tension and breakage of the web material by retarding the web material in an area of the pinching.

3. The method according to claim 2, further comprising moving the severing member towards the third winding roller and away therefrom by a reciprocating motion.

4. The method according to claim 1, further comprising moving the severing member towards the third winding roller and away therefrom by a reciprocating motion.

5. The method according to claim 1, further comprising moving the severing member towards the third winding roller and away therefrom by a reciprocating motion.

6. The method according to claim 1, wherein between the first part of winding and the second part of winding, an intermediate part of the winding cycle is performed, wherein the roll being wound is in contact with the first winding roller, the second winding roller, the third winding roller and the fourth winding roller.

7. The method according to claim 1, further comprising moving the third winding roller towards the nip between the first winding roller and the second winding roller in a roll forming phase; when the roll is in contact with the fourth winding roller, moving the third winding roller away from the nip and arranging the third winding roller in a position of co-action with said severing member; activating the severing member in a manner synchronized with positioning of the third winding roller.

8. The method according to claim 1, comprising (a) inserting a first winding core towards the first winding cradle into contact with the web material driven around the third winding roller;

(b) anchoring a leading edge of the web material to the first winding core;

(c) winding a part of a roll of web material by maintaining the first winding core in the first winding cradle, and moving forward the first winding core towards the second winding cradle;

(d) moving the first winding core, with the roll being wound around the first winding core, through the nip between the first winding roller and the second winding roller and transferring the first winding core with the roll being formed there around in the second winding cradle and completing winding of the roll of web material in said second winding cradle;

(e) inserting a second winding core towards the first winding cradle into contact with the web material driven around the third winding roller;

(f) severing the web material by said severing member to form a leading edge of web material, and removing the roll of web material from the second winding cradle;

(g) repeating steps (b) through (f) to form a further roll around another winding core, without interrupting feeding of the web material.

* * * * *